US008128388B2

(12) United States Patent
Shimoji et al.

(10) Patent No.: US 8,128,388 B2
(45) Date of Patent: Mar. 6, 2012

(54) SCROLL-TYPE EXPANSION MACHINE

(75) Inventors: Mihoko Shimoji, Tokyo (JP); Masayuki Kakuda, Tokyo (JP); Toshihide Koda, Tokyo (JP); Shin Sekiya, Tokyo (JP); Fumihiko Ishizono, Tokyo (JP); Tomokazu Matsui, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 515 days.

(21) Appl. No.: 12/438,805

(22) PCT Filed: Sep. 28, 2006

(86) PCT No.: PCT/JP2006/319297

§ 371 (c)(1),
(2), (4) Date: Feb. 25, 2009

(87) PCT Pub. No.: WO2008/038366

PCT Pub. Date: Apr. 3, 2008

(65) Prior Publication Data

US 2010/0014999 A1 Jan. 21, 2010

(51) Int. Cl.
*F03C 2/00* (2006.01)
*F04C 18/00* (2006.01)
*F04C 18/02* (2006.01)

(52) U.S. Cl. ..... 418/60; 418/55.2; 418/55.6; 418/270; 62/116; 62/498

(58) Field of Classification Search ..... 418/55.1–55.6, 418/57, 58, 60, 104, 142, 270; 62/116, 498
See application file for complete search history.

(56) References Cited

U.S. PATENT DOCUMENTS

| | | | | |
|---|---|---|---|---|
| 4,192,152 | A * | 3/1980 | Armstrong et al. | 418/55.4 |
| 5,258,046 | A * | 11/1993 | Haga et al. | 418/55.2 |
| 5,775,893 | A * | 7/1998 | Takao et al. | 418/55.2 |
| 6,464,467 | B2 * | 10/2002 | Sullivan et al. | 418/60 |
| 6,658,866 | B2 * | 12/2003 | Tang et al. | 418/60 |
| 2005/0031469 | A1 * | 2/2005 | Yanagisawa et al. | 418/60 |
| 2006/0182645 | A1 * | 8/2006 | Shibamoto et al. | 418/60 |

FOREIGN PATENT DOCUMENTS

| | | | |
|---|---|---|---|
| JP | 1 138387 | | 5/1989 |
| JP | 03059355 | A * | 3/1991 |
| JP | 03237282 | A * | 10/1991 |
| JP | 7 37857 | | 4/1995 |
| JP | 7 208353 | | 8/1995 |
| JP | 7 229482 | | 8/1995 |
| JP | 7 310682 | | 11/1995 |
| JP | 2001093553 | A * | 4/2001 |
| JP | 2001271765 | A * | 10/2001 |

(Continued)

*Primary Examiner* — Theresa Trieu
(74) *Attorney, Agent, or Firm* — Oblon, Spivak, McClelland, Maier & Neustadt, L.L.P.

(57) ABSTRACT

A scroll-type expansion machine includes an expansion mechanism including an orbiting scroll and a first fixed scroll for expanding a refrigerant and recovering a power, a sub-expansion mechanism including an orbiting scroll and a second fixed scroll for compressing the refrigerant by the power recovered by the expansion mechanism, and a seal ring disposed in at least one of an outer circumference portion of the sub-compression mechanism or an outer circumference portion of the expansion mechanism. An oil flow path is opened in an upper space of a hermetic vessel to make the upper space and a lower space at a compressed pressure of the sub-compression mechanism, and the lower space is provided with an oil pipe for communicating with the main compressor.

13 Claims, 17 Drawing Sheets

FOREIGN PATENT DOCUMENTS

| | | |
|---|---|---|
| JP | 2004 251528 | 9/2004 |
| JP | 2004 257308 | 9/2004 |
| JP | 2004 325018 | 11/2004 |
| JP | 2004 325019 | 11/2004 |
| JP | 2005 48654 | 2/2005 |
| WO | 2005 088078 | 9/2005 |

* cited by examiner

SCROLL-TYPE EXPANSION MACHINE

This application is the national phase under 35 U.S.C. §371 of PCT International Application No. PCT/JP2006/319297 which has an International filing date of Sep. 28, 2006, which designated the United States of America.

TECHNICAL FIELD

This invention relates to a scroll-type expansion machine for recovering power by expanding a refrigerant and utilizing it in compression.

BACKGROUND ART

In a conventional scroll-type expansion machine, a compression chamber of compression means is defined by a first fixed scroll and an orbiting scroll on one hand, and an expansion chamber of expansion means is defined by a second fixed scroll and the orbiting scroll. The orbiting scroll is connected to a crank shaft for being driven in an orbiting motion by a motor mounted to the crank shaft while being supported not to make a spinning motion. Also, a discharge port of a compression mechanism and a suction port of an expansion mechanism respectively are directly connected to one end of pipes for connection to the heat exchanger, whereby the suction port of the compression mechanism and the discharge port of the expansion mechanism are defined in a passage remote from the support mechanism (see Japanese Patent Publication No. 07-037857).

Such an expansion machine has a structure in which an expansion mechanism for expanding the refrigerant and a sub-compression mechanism driven by a recovered power to participate into a part of compression process are accommodated within a hermetic vessel, the hermetic vessel having maintained therein lubricating oil for the sliding portions. In the refrigeration cycle employing such the expansion machine, the lubricating oil is held at two locations of the main compressor and the expansion machine, so that the oil level must be controlled not to generate a shortage of the lubricating oil therein.

Therefore, in the refrigeration air conditioner employing the conventional expansion machine, the pressure within the hermetic vessel containing the expansion mechanism and the sub-compression mechanism is made equal or substantially equal to the discharge pressure of the main compressor, so that the expansion mechanism suctions the refrigerant from the upper portion of the expansion machine vessel, and the main compression machine is provided, when the atmosphere within the main compressor vessel is at the suction pressure, with a suction portion of the compressor above the oil level, and is provided, when the atmosphere within the main compressor vessel is at the discharge pressure, with a discharge port of the vessel above the oil level, so that the superfluous oil within the main compressor vessel can be returned together with the refrigerant to the expansion machine vessel through an external circuit, as disclosed in Japanese Patent Laid-Open No. 2004-325018.

In another refrigeration air conditioner, the pressure within the hermetic vessel containing the expansion mechanism and the sub-compression mechanism is made equal to the discharge pressure of the sub-compressor so that the expansion mechanism directly sucks the refrigerant from the outside of the expansion machine vessel and directly discharge the expanded refrigerant to the outside of the expansion vessel, and the main compressor is provided, when the atmosphere within the main compressor vessel is at the suction pressure, with a suction port of the compression mechanism above the oil level, and is provided, when the atmosphere within the main compressor vessel is at the discharge pressure, with a discharge port from the compression mechanism above the oil level, so that the superfluous oil within the main compressor vessel can be returned together with the refrigerant to the expansion machine vessel through an external circuit, as disclosed in Japanese Patent Laid-Open No. 2004-325019.

DISCLOSURE OF INVENTION

However, in the scroll-type expansion machine as above described, the expansion mechanism must be made integral with the drive source such as a motor, so that the structure is complicated. Also, under the operating conditions out of the design range, the flow rate or the differential pressure of the expansion mechanism must be decreased in order to equalize the rotational speeds of the expansion mechanism and the compression mechanism, posing a problem that the recovery power decreases. Further, since the discharge port of the compression mechanism and the suction port of the expansion mechanism are respectively directly connected to one end of the pipe connected to the heat exchanger and the suction port of the compression mechanism and the discharge port of the expansion mechanism are provided along a route distant from the space in which the support mechanism is disposed, there has been a fear that the lubricant oil circulating together with the refrigerant gas is not supplied to the sliding portion of the support mechanism, leading to the burning due to the shortage of lubrication.

Also, the refrigeration air conditioners disclosed in Japanese Patent Laid-Open Nos. 2004-325018 and 2004-325019 are both arranged such that the superfluous lubricating oil in the main compressor vessel and the expansion machine vessel is discharged together with the refrigerant to the outside of the vessel and that the oil is moved from the main compressor vessel to the expansion machine vessel or from the expansion machine vessel to the main compressor vessel, so that, when the refrigerant is compressed by the main compressor after it is compressed by the sub-compressor, the oil that flows from the main compressor vessel to the expansion machine vessel must flow via the heat exchanger of the gas cooler, whereby it is feared that the heat exchanging performance is degraded due to the lubricating oil entrained in the refrigerant.

Further, when another vessel portion such as an accumulator is provided or when the circulating circuit is elongated due to an extension piping, it may possible that the lubricating oil may stay in the vessel portion other than the main compressor or the expansion machine vessel or may need time to move and the balance of the oil level cannot temporarily be maintained and the main compressor vessel or the expansion machine vessel may become short of the lubricating oil. When the initial filing amount of the lubricating oil is increased in view of the above conditions, the oil amount is constantly superfluous within the vessel of the main compressor or the expanding machine and the agitation loss generates.

The present invention has been made to solve the above discussed problems and has as its object the provision of a scroll-type expansion machine that is simple in structure and minimized in the recovered power loss, that is arranged such that the lubrication of the sliding portion of the support mechanism and the lubricating oil level control by direct movement of the lubricating oil between the main compressor vessel and the expansion machine vessel, and that is high in efficiency under a wide range of the operating conditions and that is reliable.

According to the present invention, the scroll-type expansion machine comprises a scroll-type expansion mechanism disposed within a hermetic vessel and including an orbiting scroll and a first fixed scroll for expanding a refrigerant and recovering a power, and a scroll-type sub-compression mechanism disposed within a hermetic vessel and including an orbiting scroll having a base plate in common with the orbiting scroll of said expansion mechanism and coupled with a second fixed scroll for compressing the refrigerant by the power recovered by said expansion mechanism, wherein said first fixed scroll and said second fixed scroll define within said hermetic vessel an upper space, an orbit scroll moving space and an lower space, said orbiting scroll moving space is provided with an Oldham ring, said sub-compression mechanism has a discharge port open within said upper space, and wherein said upper space and said lower space are connected together by an oil flow path.

Also, in the scroll-type expansion machine of the present invention, when said orbiting scroll moving space is made at an expanded pressure and said upper space and said lower space is made at a compressed pressure of said sub-compression mechanism, an outer circumference seal is disposed between said fixed scroll and said orbiting scroll of said sub-compression mechanism, wherein said oil flow path is an oil return bore communicating said upper space and said lower space together without passing through said orbiting scroll moving space, and.

Also in the scroll-type expansion machine of the present invention, when said orbiting scroll moving space is made at an expanded pressure and said upper space and said lower space is made at a compressed pressure of said sub-compression mechanism, an outer circumference seal is disposed between said fixed scroll and said orbiting scroll of said expansion mechanism, wherein a sub-compressor suction pipe open within said orbiting scroll moving space is provided, wherein said oil flow path is an oil return bore communicating said upper space and said lower space together without passing through said orbiting scroll moving space.

Also in the scroll-type expansion machine of the present invention, when, said orbiting scroll moving space is made at an expanded pressure and said upper space and said lower space is made at a compressed pressure of said sub-compression mechanism, an outer circumference seal is disposed between said fixed scroll and said orbiting scroll of said expansion mechanism, wherein an outer circumference seal is disposed between said fixed scroll and said orbiting scroll of said sub-compression mechanism, wherein said oil flow path comprises a first oil return bore communicating said upper space and said orbiting scroll moving space and a second oil return bore communicating said orbiting scroll moving space said lower space.

Further, in the refrigeration cycle apparatus of the present invention, the apparatus comprises, for constituting a refrigeration cycle, a main compression mechanism for compressing a refrigerant; a gas cooler for cooling the compressed refrigerant, a scroll-type expansion machine, including said expansion mechanism for expanding the refrigerant from said gas cooler to recover the power, and said sub-compression mechanism for compressing the refrigerant compressed by said main compression mechanism by the power recovered by said expansion mechanism, and an evaporator for evaporating the refrigerant expanded by said expansion mechanism, wherein an oil pipe is provided for connecting a main compressor vessel of said main compression mechanism or a compression chamber of said main compression mechanism to a bottom portion of a lower space of said hermetic vessel accommodating said expansion mechanism and said sub-compression mechanism or a position higher than a proper oil level within said lower space.

According to the present invention, it is possible to provide a scroll-type expansion machine that is simple in structure and minimized in the recovered power loss, that is arranged such that the lubrication of the sliding portion of the support mechanism and the lubricating oil level control by direct movement of the lubricating oil between the main compressor vessel and the expansion machine vessel, and that is high in efficiency under a wide range of the operating conditions and that is reliable.

BRIEF DESCRIPTION OF THE DRAWINGS

The present invention will become more readily apparent from the following detailed description of the preferred embodiments of the present invention taken in conjunction with the accompanying drawings, in which.

BEST MODE FOR CARRYING OUT THE INVENTION

Embodiment 1

Figure 1:
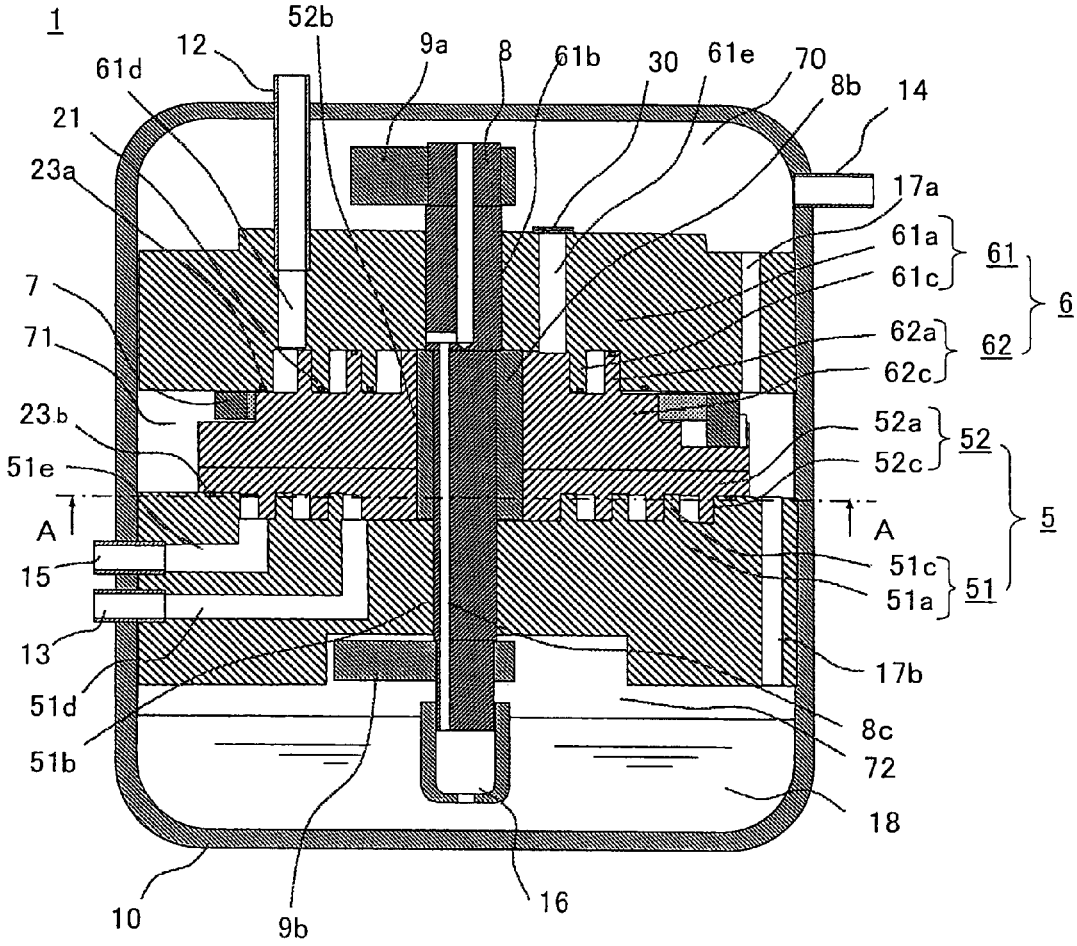
FIG. 1 is a longitudinal sectional view of the scroll-type expansion machine according to embodiment 1 of the present invention.

FIG. 1 is a longitudinal sectional view of the scroll-type expansion machine according to embodiment 1 of the present invention. In the figure, the same reference characters designate the same or corresponding components throughout the entire specification.

In FIG. 1, disposed at the lower portion of a hermetic vessel 10 of a scroll-type expansion machine 1 is an expansion mechanism 5, above which a sub-compression mechanism 6 is provided. The expansion mechanism 5 comprises a fixed scroll 51 (first fixed scroll) having a spiral tooth 51*c* formed on a base plate 51*a* and an orbiting scroll 52 having a spiral tooth 52*c* formed on a base plate 52*a*, the spiral tooth 51*c* of the fixed scroll 51 and the spiral tooth 52*c* of the orbiting scroll 52 being arranged to mesh with each other. The sub-compression mechanism 6 comprises a fixed scroll 61 (second fixed scroll) having a spiral tooth 61*c* formed on a base plate 61*a* and an orbiting scroll 62 having a spiral tooth 62*c* formed on a base plate 62*a*, the spiral tooth 61*c* of the fixed scroll 61 and the spiral tooth 62*c* of the orbiting scroll 62 being arranged to mesh with each other.

A shaft 8 is rotatably supported at both end portions by bearing portions 51*b* and 61*b* provided at the centers of the fixed scroll 51 of the expansion mechanism 5 and the fixed scroll 61 of the sub-compression mechanism 6. The orbiting scroll 52 of the expansion mechanism 5 and the orbiting scroll 62 of the sub-compression mechanism 6 are supported by a crank portion 8*b* fitted over the shaft 8 which extends through and supports the scrolls for orbiting movements.

The shaft 8 has mounted at its lower end an oil supply pump 16 and has an oil supply bore 8*c* formed within the shaft 8. In the outer circumference portion of the fixed scroll 61, an oil return bore 17*a* communicating an upper space 70 defined above the fixed scroll 61 with an orbiting scroll moving space 71 defined between the fixed scroll 61 and the fixed scroll 51. Also, in the outer circumference portion of the fixed scroll 51, an oil return bore 17*b* communicating the orbiting scroll moving space 71 with a lower space 72 defined under the fixed scroll 51, a lubricating oil 18 is stored in the lower space 72.

At an outer circumference of the expansion mechanism 5 and in a side wall of the hermetic vessel 10, an expansion suction pipe 13 for suctioning a refrigerant and an expansion discharge pipe 15 for discharging the expanded refrigerant are provided. On the other hand, in an upper wall of hermetic vessel 10 above the sub-compression mechanism 6, a sub-compression suction pipe 12 for suctioning the refrigerant is provided and, in the side wall of the hermetic vessel 10 at a level higher than the fixed scroll 61, a sub-compression discharge pipe 14 for discharging the compressed refrigerant is provided.

In the expansion mechanism 5, a base plate 51*a* of the fixed scroll 51 has formed therein an expansion suction port 51*d* for sucking the refrigerant and an expansion discharge port 51*e* for discharging the refrigerant, which are connected to the expansion suction pipe 13 and the expansion discharge pipe 15. In the sub-compression mechanism 6, a base plate 61*a* of the fixed scroll 61 has formed therein an expansion suction port 61*d* for sucking the refrigerant and an expansion discharge port 61*e* for discharging the refrigerant, the sub-compression suction port 61*d* being connected to the sub-compression suction pipe 12 and a discharge valve 30 for opening and closing the sub-compression discharge port 61*e* is mounted on the base plate 61*a* of the fixed scroll 61.

In the sub-compression mechanism 6, an outer circumference seal 23*a* for sealing between the fixed scroll 61 and the orbiting scroll 62 is disposed in a surface of the fixed scroll 61 opposing to the orbiting scroll 62 and at the outer circumference of the spiral tooth 61*c*.

On the other hand, in the expansion mechanism 5, an outer circumference seal 23*b* for sealing between the fixed scroll 51 and the orbiting scroll 52 is disposed in a surface of the fixed scroll 51 opposing to the orbiting scroll 52 and at the outer circumference of the spiral tooth 51*c*.

The orbiting scroll 52 of the expansion mechanism 5 and the orbiting scroll 62 of the sub-compression mechanism 6 are integrated by a connecting element such as a pin and are restricted against the spinning movement by an Oldham ring 7 disposed in the sub-compression mechanism 6. In order to cancel out centrifugal forces generated by the orbiting movements of the orbiting scrolls 52 and 62, balance weights 9*a* and 9*b* are mounted to either ends of the shaft 8. The orbiting scroll 52 of the expansion mechanism 5 and the orbiting scroll 62 of the sub-compression mechanism 6 may be integrated with the base plates 52*a* and 62*a* used in common.

In the expansion mechanism 5, a high pressure refrigerant sucked from the expansion suction pipe 13 is expanded within an expansion chamber 5*a* defined by the spiral tooth 51*c* of the fixed scroll 51 and the spiral tooth 52*c* of the orbiting scroll 52 to generate a power. The refrigerant de-pressurized within the expansion chamber 5*a* is discharged to the outside of the hermetic vessel 10 from the expansion discharge pipe 15. The refrigerant is suctioned through the sub-compression suction pipe 12 into the sub-compression chamber 6*a* defined by the spiral tooth 61*c* of the fixed scroll 61 and the spiral tooth 62*c* of the orbiting scroll 62, where the refrigerant is compressed by the power generated in the expansion mechanism 5. The refrigerant compressed and pressurized within the sub-compression chamber 6*a* flows from the sub-compression discharge port 61*e* and is discharged into the upper space 70 within the hermetic vessel 10 through the discharge valve 30 and then to the outside of hermetic vessel 10 through the sub-compression discharge pipe 14.

Figure 2:
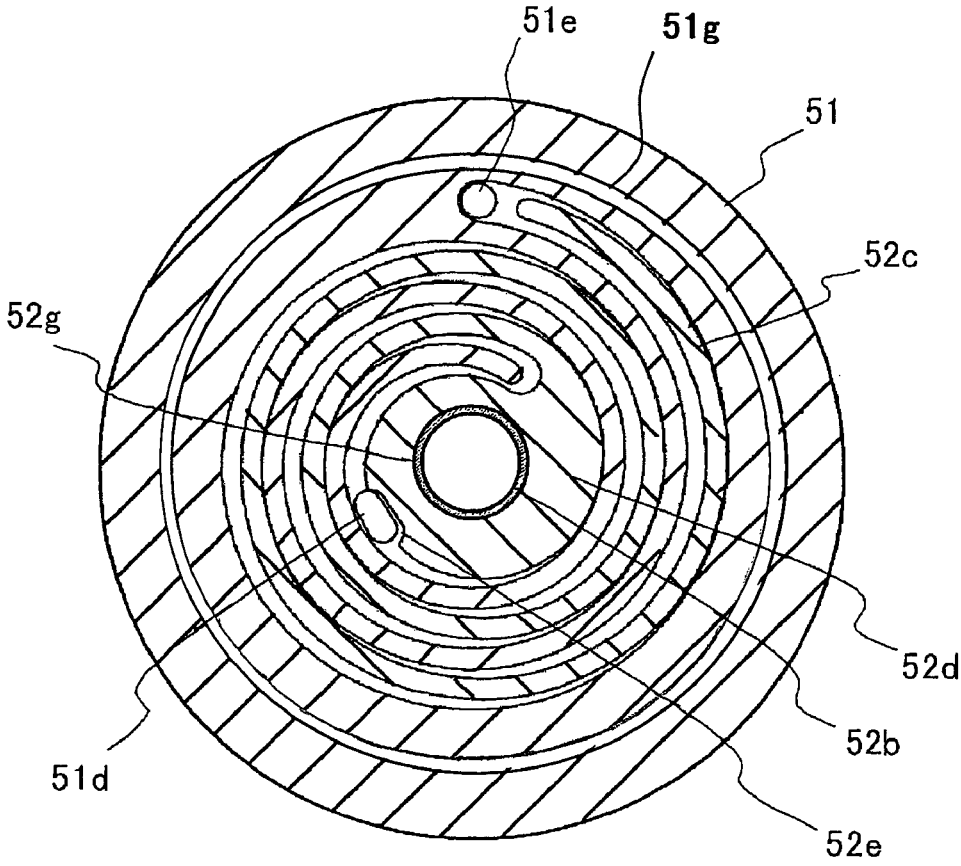
FIG. 2 is a cross sectional view of the expansion mechanism of the scroll-type expansion machine according to embodiment 1 of the present invention.

FIG. 2 is a sectional view taken along line A-A of the expansion mechanism of the scroll-type expansion machine according to embodiment 1 of the present invention illustrated in FIG. 1.

At the inner end portion of the spiral tooth 52*c* of the orbiting scroll 52, a thick portion 52*d* is provided and the thick portion 52*d*, in which an eccentric bearing portion 52*b* through which the crank portion 8*b* is inserted is provided to extend therethrough.

The expansion suction port 51*d* disposed in the base plate 51*a* of the fixed scroll 51 has a configuration of an elongated hole for obtaining opening area, and the thick portion 52*d* is provided with a cut out portion 52*e* in order to reduce the area of the expansion suction port 51*d* that is closed during the orbiting motion. Also the expansion discharge port 51*e* is provided at a position so that it does not interfere with the outer end portion of the spiral tooth 52*c* of the orbiting scroll 52.

The base plate 51*a* of the fixed scroll 51 has an outer circumference seal groove 51*g* formed in the outside portion of the spiral tooth 51*c* for mounting the outer circumference seal 23*b* therein.

Figure 3A:
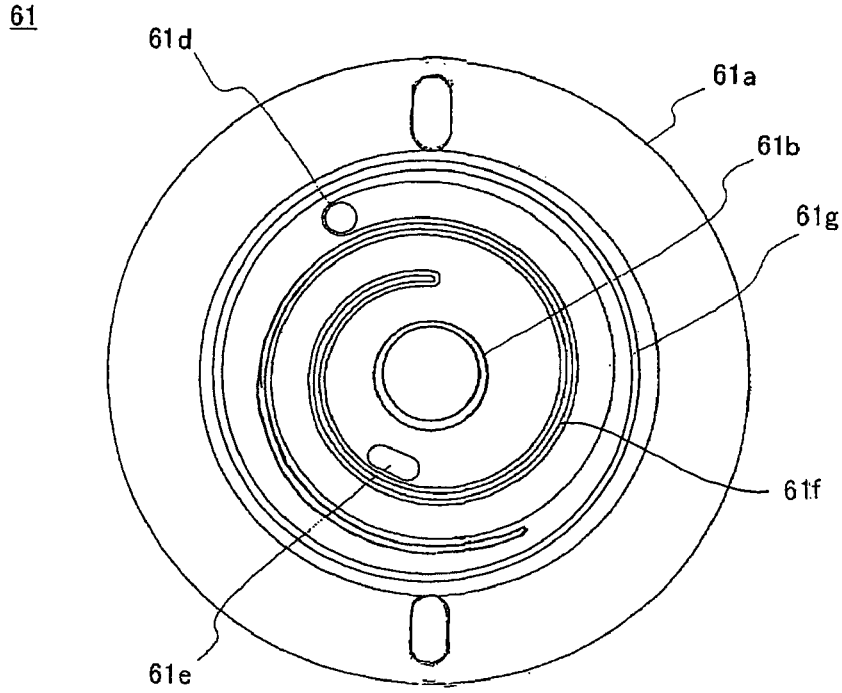
FIG. 3*a* is a plan view of the fixed scroll of the sub-compression mechanism of the scroll-type expansion machine according to embodiment 1 of the present invention.
Figure 3B:
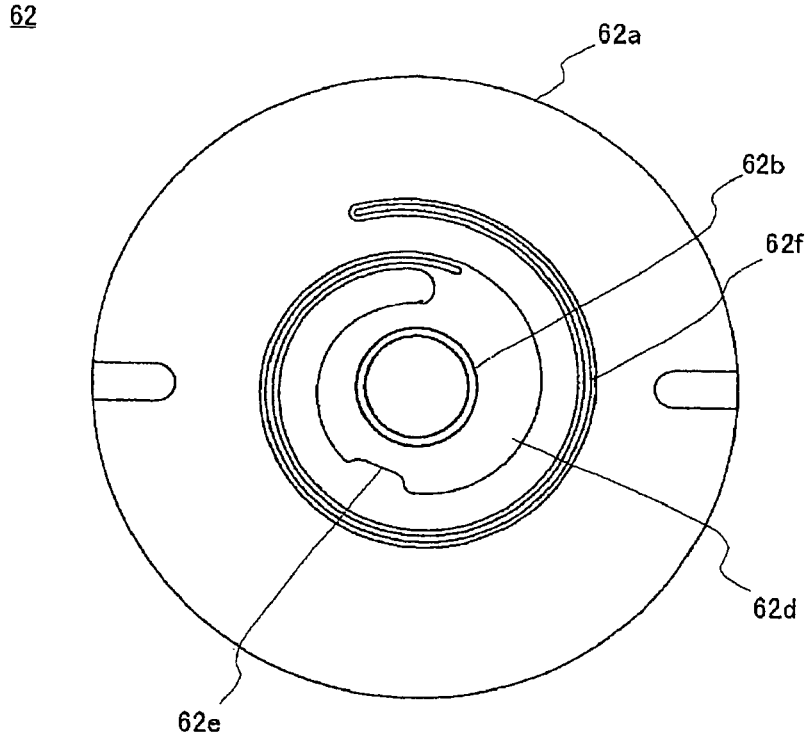
FIG. 3*b* is a plan view of the orbiting scroll of the sub-compression mechanism of the scroll-type expansion machine according to embodiment 1 of the present invention.

FIGS. 3*a* and 3*b* are plan views illustrating the sub-compression mechanism according to embodiment 1 of the present invention, FIG. 3*a* being a plan view of the fixed scroll of the sub-compression mechanism and FIG. 3*b* being a plan view of the orbiting scroll of the sub-compression mechanism. As shown in FIGS. 3*a* and 3*b*, the spiral teeth 61*c* and 62*c* of the sub-compression mechanism 5 are wound in the same direction and, when the orbiting scroll 62 achieves the orbiting movement together with the orbiting scroll 52 coupled in the back-to-back relationship, the compression is achieved on one side and the expansion is achieved on the other side.

Similarly to the orbiting scroll 52 of the expansion mechanism 5, the thick portion 62*d* of the orbiting scroll 62 has formed therein an eccentric bearing portion 62*b* to which the crank portion 8*b* is inserted. The sub-compression discharge port 61*e* has a configuration of an elongated hole for obtaining opening area, and the thick portion 62*d* is provided with a cut out portion 62*e* in order to reduce the area of the sub-compression discharge port 61*e* that is closed during the orbiting motion. Also the sub-compression suction port 61*d* is provided at a position that does not interfere with the outer end portion of the spiral tooth 62*c* of the orbiting scroll 62.

The spiral teeth 61*c* and 62*c* has tip seal grooves 61*f* and 62*f* formed at its tip surface. Also, the base plate 61*a* of the fixed scroll 61 has an outer circumference groove 61*g* formed radially outside of the spiral tooth 61*c* for inserting therein the outer circumference seal 23*a*.

Figure 4:
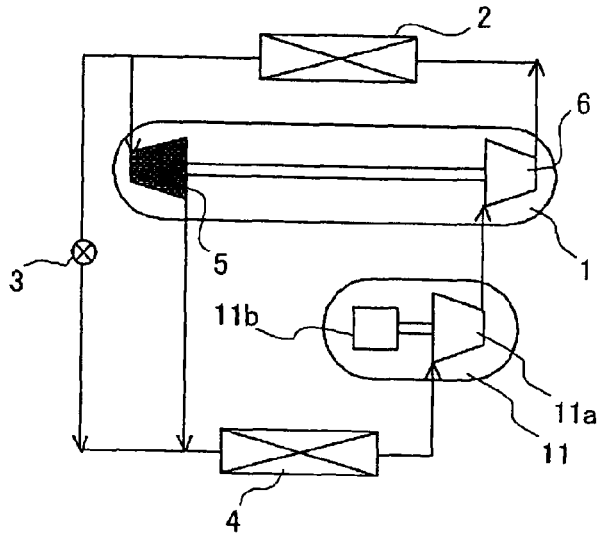
FIG. 4 is a circuit diagram the basic elements of the refrigeration cycle using the scroll-type expansion machine according to embodiment 1 of the present invention.

FIG. 4 is a circuit diagram the basic elements of the refrigeration cycle using the scroll-type expansion machine according to embodiment 1 of the present invention. In this embodiment 1, the refrigerant is explained as being a refrigerant, such as carbon dioxide, that becomes supercritical at the high pressure side.

In FIG. 4, a main compression mechanism 11*a* driven by the motor mechanism 11*b* of the main compressor 11 is disposed at a preceding stage of the sub-compression mechanism 6 driven by the expansion mechanism 5 of the scroll-type expansion machine 1, and an evaporator 4 for heating the refrigerant is disposed at a preceding stage of the main compression mechanism 11*a*. On the other hand, a gas cooler 2 for cooling the refrigerant is disposed at the subsequent stage of the sub-compression mechanism 6, and the expansion mechanism 5 of the scroll-type expansion machine 1 and the expansion valve 3 are disposed in parallel at the subsequent stage of the gas cooler 2.

The refrigerant pressurized in the main compression mechanism 11*a* of the main compression machine 11 is further pressurized by the sub-compression mechanism 6 of the scroll-type expansion machine 1. The refrigerant pressurized by the sub-compression mechanism 6 is cooled by the gas cooler 2 and partially supplied to the expansion mechanism 5 of the scroll-type expansion machine 1, where the refrigerant is expanded and depressurized. In order to adjust the flow rate of the refrigerant through the expansion mechanism 5 and to maintain a pressure difference upon the start up, an expansion valve 3 is disposed in parallel to the expansion mechanism 5 of the scroll-type expansion machine 1. The remaining refrigerant is supplied to the expansion valve 3 and expanded and depressurized. The isentropic expansion of the refrigerant causes the expansion mechanism 5 to transmit an expansion power to the sub-compression mechanism 6 via the main shaft 8, where the power is utilized as the sub-compression work. The expanded refrigerant from the expansion mechanism 5 is heated by the evaporator 4 and is returned back to the main compression mechanism 11*a* of the main compression machine 11.

Figure 5:
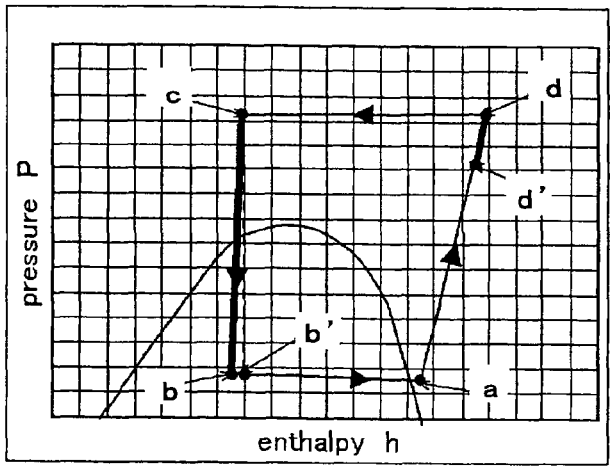
FIG. 5 is a Mollier chart showing the variation in state amount of the refrigerant in the refrigeration cycle using the scroll-type expansion machine according to embodiment 1.

FIG. 5 is a Mollier chart showing the variation in state amount of the refrigerant in the refrigeration cycle using the scroll-type expansion machine according to embodiment 1 of the present invention. In FIG. 5, the axis of ordinate represents pressure P and the axis of abscissa represents enthalpy.

As shown in FIG. 5, the refrigerant cooled by the heat exchange in the gas cooler 2 from a point d to a point c is subjected to isenthalpic expansion from the point c to a point b' with a depressurization mechanism of an orifice such as an expansion valve. However, in the expansion mechanism 5, the change is from the point c to a point b due to the isentropic expansion. Therefore, an expansion power corresponding to the enthalpy difference between the enthalpy $h_{b'}$ at the point b' and the enthalpy $h_b$ at the point b is recovered. The expanded refrigerant gas is heat exchanged by the evaporator 4 and heated from the point b to the point a and, after compressed from the point a to the point d' by the main compression mechanism 11*a* of the main compressor 11, compressed from the point d' to the point d by the sub-compression mechanism 6 of the scroll-type expansion machine 1. As noted above, in embodiment 1 of the present invention, one part of compression process of the refrigeration cycle is carried out by the compression mechanism 11*b* of the main compressor 11 and the remaining part of the compression process is carried out by the sub-compression mechanism 6 of the scroll-type expansion machine 1. The compression power corresponding to the enthalpy difference $h_d$-$h_{d'}$ in the sub-compression mechanism 6 is provided by the recovered power corresponding to the difference $h_{b'}$-$h_b$.

Figure 6:
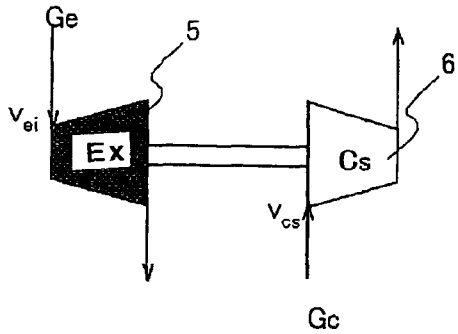
FIG. 6 is a schematic diagram for explaining the relationship between the flow rate and the rotational speed of a typical expansion/compression mechanism.

FIG. 6 is a schematic diagram for explaining the relationship between the flow rate and the rotational speed of a typical expansion/compression mechanism.

As shown in FIG. 6, when the sub-compression mechanism 6 driven by the expansion mechanism 5 is used, the number of rotation $N_E$ determined on the side of the expansion mechanism 5 is expressed by the equation (1) given below, where Ge is the mass flow rate of the refrigerant flowing through the expansion mechanism 5, Gc is the mass flow rate of the refrigerant flowing through the sub-compression mechanism 6, Vei is the suction stroke volume of the expansion mechanism 5, Vcs is the suction stroke volume of the sub-compression mechanism 6, $v_{ei}$ is the refrigerant specific volume at the inlet of the expansion mechanism 5 and $v_{cs}$ is the refrigerant specific volume at the inlet of the compression mechanism 6.

$$N_E = Gev_{ei}/Vei \quad (1)$$

Also, the rotational number Nc at the side of the sub-compression mechanism 6 is expressed by equation (2) given below.

$$N_C = Gcv_{cs}/Vcs \quad (2)$$

Therefore, from $N_E = N_C$, which is the condition for matching the rotational speeds of the expansion mechanism 5 and the sub-compression mechanism 6, an equation (3) given below must be satisfied.

$$Gev_{ei}/Gcv_{cs} = Vei/Vcs = \sigma_{vec} \quad (3)$$

The stroke volume ratio σvec of the expansion mechanism 5 and the sub-compression mechanism 6 expressed in equation (3) is a constant when the dimensions of the apparatus are determined under a certain design conditions. When the device is to be operated under the conditions other than the design conditions, it is necessary to adjust the volume flow rate ratio ($Gev_{ei}/Gcv_{cs}$) so that the equation (3) is fulfilled. When all of the compression process of the refrigeration cycle is to be achieved by the sub-compression mechanism 6 (in which case, the sub-compression mechanism 6 needs to use not only the recovered power from the expansion mechanism 5 but also another drive source), the specific volumes $v_{ei}$ and $v_{cs}$ at the respective inputs of the expansion mechanism 5 and the sub-compression mechanism 6 are determined by the operation condition, so that the mass flow rate Ge is usually adjusted by means of by-pass such as the expansion valve 3. At this time, since the mass flow rate to be by-passed is a non-recovered flow rate from which the expansion power cannot be recovered and the power recovery efficiency decreases, the by-pass flow rate should be made as small as possible.

As shown in FIG. 5, when one portion (from point a to point d') of the compression process of the refrigeration cycle is achieved by the main compression mechanism 11*a* driven by the electric motor mechanism 11*b*, and when the remaining portion (from point d' to point d) of the compression stroke is achieved by the sub-compression mechanism 6 driven by the recovered powered, the specific volume $v_{cs}$ at the inlet of the sub-compression mechanism 6 varies according to the pressure at the point d'. Therefore, even when the specific volume has been determined on the basis of the operational conditions, the specific volume $v_{cs}$ at the inlet of the sub-compression mechanism 6 can be adjusted for the rotational speed matching. However, since the drive of the sub-compression mechanism 6 is achieved only by the expansion mechanism 5, it is also necessary to match the power by providing the compression power from the recovered power. There is a lower limit in the pressure at the point d' in FIG. 5 and there is a limit in adjusting the specific volume $v_{cs}$ of the input of the sub-compression mechanism 6 by the pressure at the point d'. Therefore, in order to satisfy the conditions of matching the rotational speed according to the equation (3) and maintain the balance in the powers on the sides of the expansion mechanism 5 and the sub-compression mechanism 6, the adjustment of the mass flow rate Ge through the expansion mechanism 5 is to be achieved by-passing the refrigerant of the expansion valve 3 or the like provided in parallel to the expansion mechanism 5.

As has been described, the decrease in the recovery efficiency by by-passing can be much reduced when one portion of the compression process of the refrigeration cycle is achieved by the main compression mechanism 11*a* driven by the electric motor mechanism 11*b* and the remaining portion of the compression process is achieved by the sub-compression mechanism 6 of the scroll-type expansion machine 1 driven by the recovered power than when all of the compression process of the refrigeration cycle is achieved by the sub-compression mechanism 6 of the scroll-type expansion machine 1. This is because, in the former case, both of the adjustment of the rotational speed by the specific volume vcs at the inlet of the sub-compression mechanism 6 and the adjustment of the compression power by the pressurizing range at the sub-compression mechanism 6.

Figure 7:
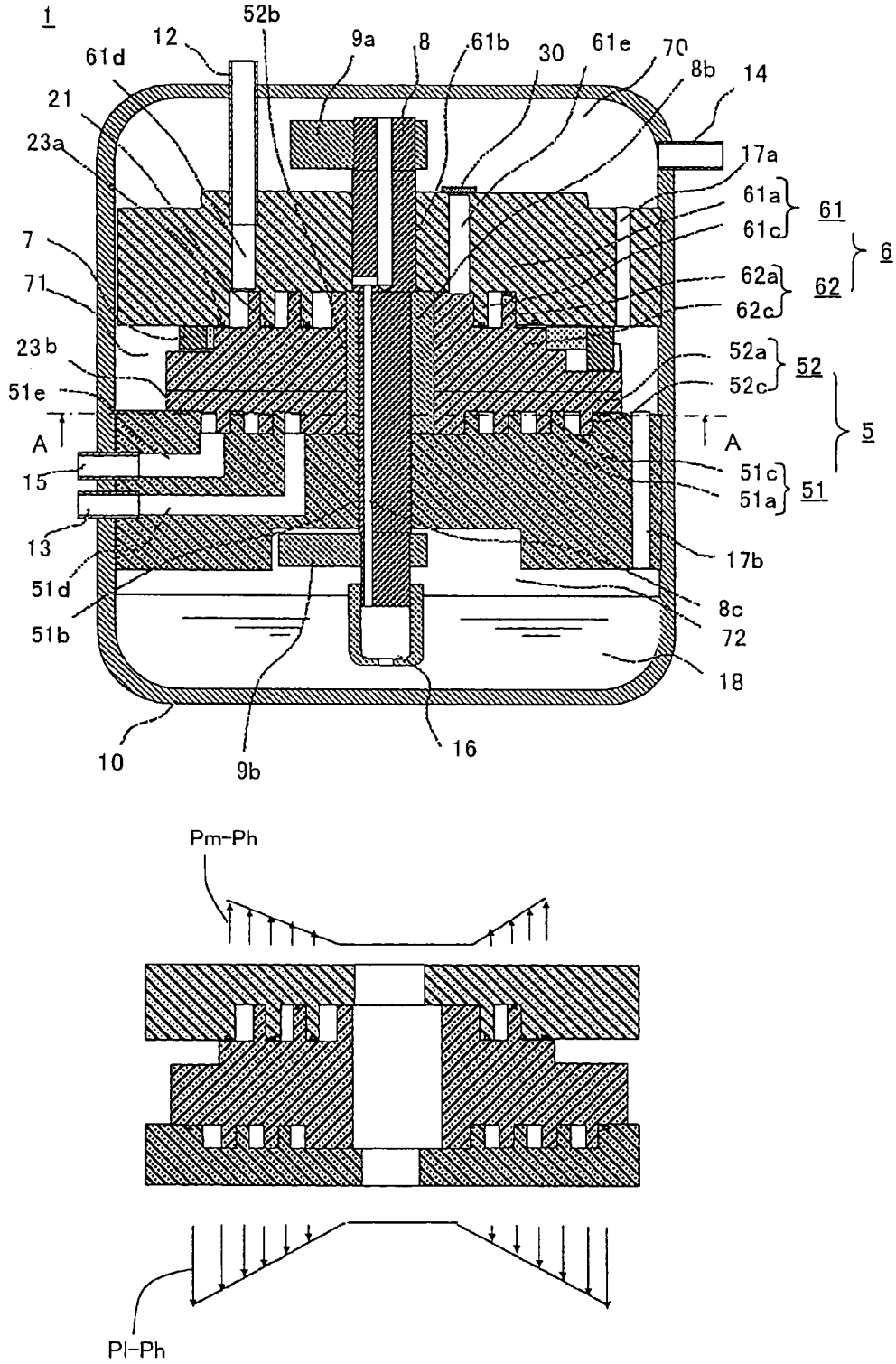
FIG. 7 is a schematic sectional view of the expansion machine and the sub-compression mechanism of the scroll-type expansion machine according to embodiment 1 of the present invention.

FIG. 7 is a schematic sectional view of the expansion mechanism and the sub-compression mechanism of the scroll-type expansion machine according to embodiment 1 of the present invention.

The spiral teeth 61*c* and 62*c* of the sub-compression mechanism 6 have mounted thereon tip seals 21 for defining a sub-compression chamber 6*a*. An outer circumference seal 23*a* is also provided on the base plate 61*a* of the fixed scroll 61 of the sub-compression mechanism 6 at the outside of the spiral tooth 61*c*. In the expansion mechanism 5, the outer circumference portion of the base plate 51*a* of the fixed scroll 51 and the outer circumference portion of the base plate 52*a* of the orbiting scroll 52 are arranged to contact with each other. An outer circumference seal 23*b* is provided on the base plate 51*a* of the fixed scroll 51 of the expansion mechanism 5 at the outside of the spiral tooth 51*a*.

Figure 8:
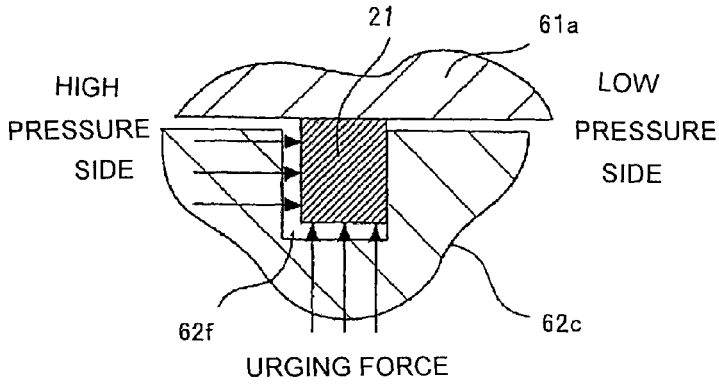
FIG. 8 is a schematic view for explaining the contact sealing function of a typical tip seal.

FIG. 8 is an enlarged sectional view of the tip seal and its vicinity for explaining the contact seal function of the tip seal.

In FIG. 8, the tip seal 21 is urged from the left above and the lower side which is a high pressure sides by the pressure difference between both of the sub-compression chambers 6*a* partitioned by the seal. Therefore, the tip seal 21 is urged against the right hand wall and the base plate above the plate within the tip seal groove 62*f* provided for mounting the tip seal 21 therein, thus establishing a contact seal between the orbiting scroll 62 and the fixed scroll 61. The contact seal function of the outer circumference seal 23 is similar to the contact seal function of the tip seal 21.

In embodiment 1 of the present invention, the expansion mechanism 5 carries out the expansion process of from high pressure Ph (the pressure at the point c) to low pressure Pl (the pressure at the point b) and the sub-compression mechanism 6 carries out the compression process from the intermediate pressure Pm (the pressure at the point d') to the high pressure Ph (the pressure at the point d which nearly equals to the pressure at the point c). Therefore, in the orbiting scrolls 52 and 62, the high pressure Ph acts at both of the central expansion chamber 5*a* and the central compression chamber 6*a*, the lower pressure Pl acts at the outer circumference expansion chamber 5*a*, and the intermediate pressure Pm acts at the outer circumference sub-compression chamber 6*a*. Since the hermetic vessel 10 is at the high pressure Ph, the outer circumference seal 23*a* is disposed on the outer circumference of the spiral tooth 61*c* on the base plate 61*a* of the fixed scroll 61 of the sub-compression mechanism 6. Also, the outer circumference seal 23*b* is disposed on the outer circumference of the spiral tooth 61*c* on the base plate 51*a* of the fixed scroll 51 of the expansion mechanism 5 in order to seal the pressure difference between the expansion chamber 5*a* (Pl) and the hermetic vessel 10 (Ph).

When the upper space 70 and the lower space 72 of the hermetic vessel 10 are made at the lower pressure Pl or the intermediate pressure Pm, inner circumference seals are needed to be provided at the outer circumference of the eccentric bearings 52*b* and 62*b* of the orbiting scrolls 52 and 62 in order to seal the pressure difference between the central sub-compression chamber 6*a* (Ph) and the upper space 72 and the pressure difference between the central expansion chamber 5*a* (Ph) and the lower space 71 and the hermetic vessel 10 upper space (Pl). Also, since the discharge port 61*e* and the sub-compression discharge tube 14 are connected without passing through the upper space 70, the discharge valve space at the high pressure Ph for attaching the discharge valve 30 is necessary to be disposed within the fixed scroll 61 separate from the upper space at the low pressure Pl, whereby the structure around the discharge valve becomes complicated. From this, when the upper space 70 and the lower space 72 of the hermetic vessel 10 is made at the high pressure Ph, there is no need to provide an inner circumference seal, making the structure about the discharge valve of the sub-compression mechanism simple and decreasing the manufacturing cost.

In FIG. 7, arrows represent the distribution of the pressure difference in the axial direction acting on the orbiting scrolls 52 and 62 with reference to the high pressure Ph. The pressure difference at the central portion of the orbiting scrolls 52 and 62 is 0 on both of the side of the expansion mechanism 5 and the side of the sub-compression mechanism 6. However, the pressure difference at the outer circumference portion of the orbiting scrolls 52 and 62 is Pl-Ph on the side of the expansion mechanism 5 and is Pm-Ph on the side of the sub-compression mechanism 6. The orbiting scrolls 52 and 62 are subjected to a downward urging force F in the direction of the shaft 8 (the force from the side of the sub-compression mechanism 6 to the side of the expansion mechanism 5), the urging force F being supported by the tip faces of the spiral teeth 51*c* and 52*c* of the expansion mechanism 5 and the base plate 51*a* and 52*a*.

The diameter of the outer circumference seal groove 61*g* in which the outer circumference seal 23*a* is mounted in the sub-compression mechanism 6 or the diameter of the outer circumference seal groove 51*g* in which the outer circumference seal 23*b* is mounted in the expansion mechanism 5 are selected so that the urging forces at the tip faces of the spiral teeth 51*c* and 52*c* of the expansion mechanism 5 as well as the base plates 51*a* and 52*a* does not become excessively large. That is, when the urging force is to be limited, the diameter of the outer circumference seal groove 61*g* is made large to increase the area at which the sub-compression mechanism 6 receives the intermediate pressure Pm, or the diameter of the outer circumference seal groove 51*g* is made small to decrease the area at which the expansion mechanism 5 receives the low pressure Pl.

In the scroll-type fluid machine, the axial position of the orbiting scroll is determined by the point at which the axial force due to the pressure of the refrigerant in either case of the compressor or the expansion machine and in either case of a one-sided spiral structure in which the scroll teeth is disposed only one side of the orbiting scroll or of a two-sided spiral structure in which the scroll teeth is disposed at both side of the orbiting scroll, and a gap corresponding to an assembly clearance is formed at the side opposite to the urging face of the orbiting scroll. Therefore, a leak occurs between the expansion chambers 5*a* or the sub-compression chamber 6*a* having different pressure.

In the scroll-type expansion machine of embodiment 1, the orbiting scrolls 52 and 62 are pressed integrally against the fixed scroll 51 of the expansion mechanism 5 by the urging force F, there is provided almost no gap at the tips of the spiral teeth 51*c* and 52*c* of the expansion mechanism 5. Therefore, with the carbon dioxide which has a very high pressure at the high pressure Ph, the pressure difference between the intermediate pressure Pm and the low pressure Pl is large, so that the amount of adjustment of the diameter of the outer circumference seal 23*a* and 23*b* for obtaining the necessary urging force F can be small, thus there is no need to increase the outer diameter. On the other hand, in the sub-compression mechanism 6, there are gaps generated between the tip face of the spiral tooth 62*c* of the orbiting scroll 62 and the base plate 61*a* of the fixed scroll 61 as well as between the base plate 62*a* of the orbiting scroll 62 of the sub-compression mechanism 6 and the tip face of the spiral tooth 61*c* of the fixed scroll 61. However, since the tip seals 21 are mounted at the tips of the spiral teeth 61*c* and 62*c*, there is almost no radial outward leak from the inside of the spiral teeth 61*c* and 62*c* and the leak can be limited only in the circumferential direction along the spiral teeth 61*c* and 62*c* at the side of the tip seals 21.

Also, in the expansion mechanism 5, the outer circumference portion of the base plate 51*a* of the fixed scroll 51 and the outer circumference portion of the base plate 52*a* of the orbiting scroll 52 are arranged to contact with each other, so that the urging force F can be supported by a wider area, decreasing the absolute value of the pressure acting on the tip of the spiral teeth 51*c* and 52*c* as well as the variation width of the working pressure.

Here, the relationship between the radius r of orbiting of the expansion mechanism 5 and the sub-compression mechanism 6 is expressed by the equation (4), where p is the pitch of the spiral tooth and t is the thickness of the spiral tooth.

$$r=(p/2)-t \tag{4}$$

In embodiment 1, the orbiting radius r for the expansion mechanism 5 and the sub-compression mechanism 6 are equal to each other. However, as for the thickness t of the spiral tooth, the spiral teeth 51*c* and 52*c* of the expansion mechanism 5 is larger than the spiral teeth 61*c* and 62*c* of the sub-compression mechanism 6. Also, the pitch p of the spiral tooth is larger in the spiral teeth 51*c* and 52*c* of the expansion mechanism 5 than in the spiral teeth 61*c* and 62*c*. The thickness t of the spiral tooth is larger for the spiral teeth 51*c* and 52*c* of the expansion mechanism 5 than for the spiral teeth 61*c* and 62*c* of the sub-compression mechanism 6, the larger mechanical strength can be provided in the spiral teeth 51*c* and 52*c* of the expansion mechanism 5 having a higher pressure difference between the pressures before and after the expansion than the pressure difference generated in the sub-compression mechanism 6.

According to the above described construction, one portion of the compression process of the refrigeration cycle is carried out by the sub-compression mechanism 6 of the scroll-type expansion machine 1, so that the decrease in the recovery effect due to the by-passing can be suppressed and the scroll-type expansion machine having a high efficiency over a wide range of operating condition can be obtained. Also, the orbiting scrolls 52 and 62 are arranged so that they are pressed under pressure against the fixed scroll 51 of the expansion mechanism 5 and that the tip seal 21 is provided to each of the spiral teeth 61*c* and 62*c* of the fixed scroll 61 and the orbiting scroll 62 of the sub-compression mechanism 6, so that the leakage loss can be decreased.

Also, since the arrangement is such that the tip portion of the spiral teeth 51*c* and 52*c* of the expansion mechanism 5 and the outer circumference portion of the base plates 51*a* and 52*a* are urged by the compression from the intermediate pressure Pm to the high pressure Ph at the sub-compression mechanism 6, the pressure increase at the sub-compression mechanism 6 takes place only after the start of the machine and the entire area of the central portion and the outer peripheral portion of the sub-compression mechanism 6 is at the high pressure Ph before starting, ensuring that the tooth tip of the expansion mechanism 5 is urged against the base plate, so that starting easiness of the scroll-type expansion machine 1 can be obtained.

Also, when expansion power of the expansion mechanism 5 causes the shaft 8 to rotate, the oil pump 16 supplies the lubricating oil 18 to each of the bearing portions 61*b*, 62*b*, 52*b* and 51*b* via oil supply port 8*c*. The oil leaked into the upper space 70 out of the oil supplied to the bearing portions 61*b*, 62*b*, 52*b* and 51*b* flows through the oil return bore 17*a* to the orbiting scroll moving space 71 and, after lubricating the Oldham ring 7, returned via the oil return bore 17*b* to the oil reservoir portion of the lower space 72, thus constituting the oil supply mechanism.

The discharged gas from the sub-compression mechanism is discharged into the upper space 70 from the sub-compression discharge port 61*e* via the discharge valve, so that the oil circulating together with the discharged gas within the upper space 70 is separated, advantageously preventing the degrading of the performance of the heat exchanger due to the mixture of the oil into the refrigerant.

Embodiment 2

Figure 9:
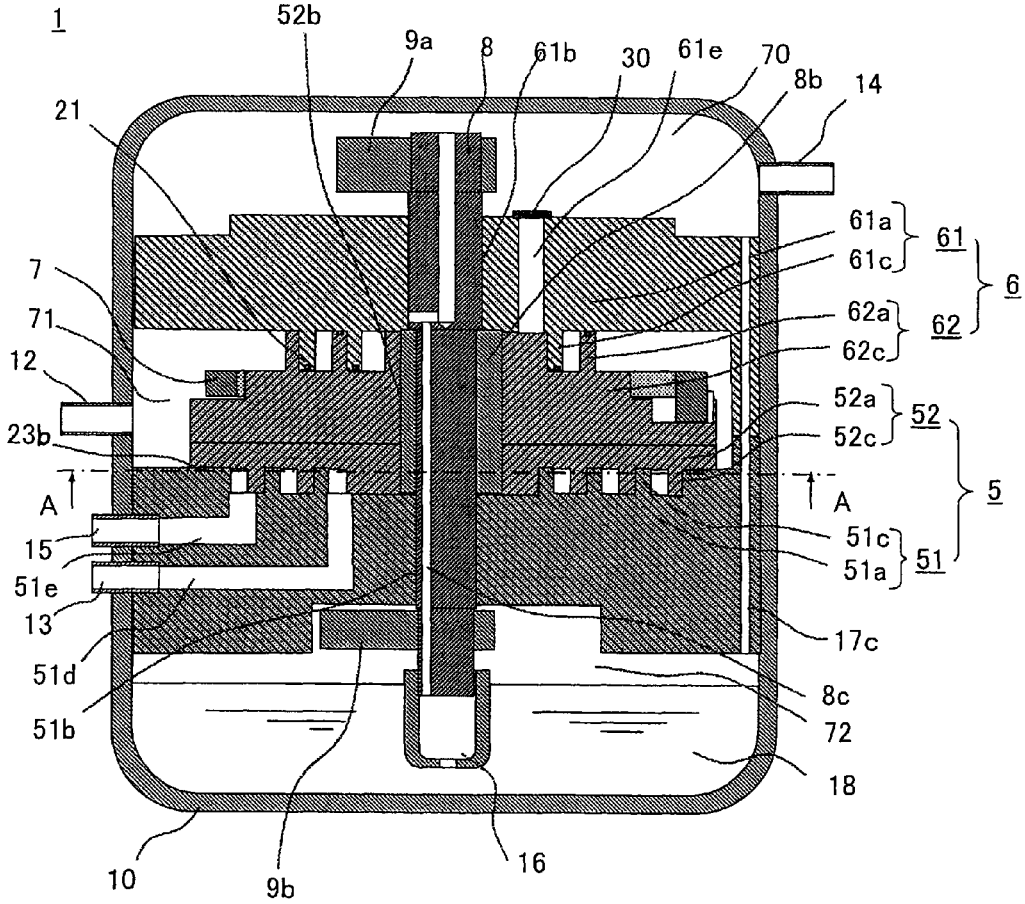
FIG. 9 is a longitudinal sectional view of the scroll-type expansion machine according to embodiment 2 of the present invention.
Figure 10:
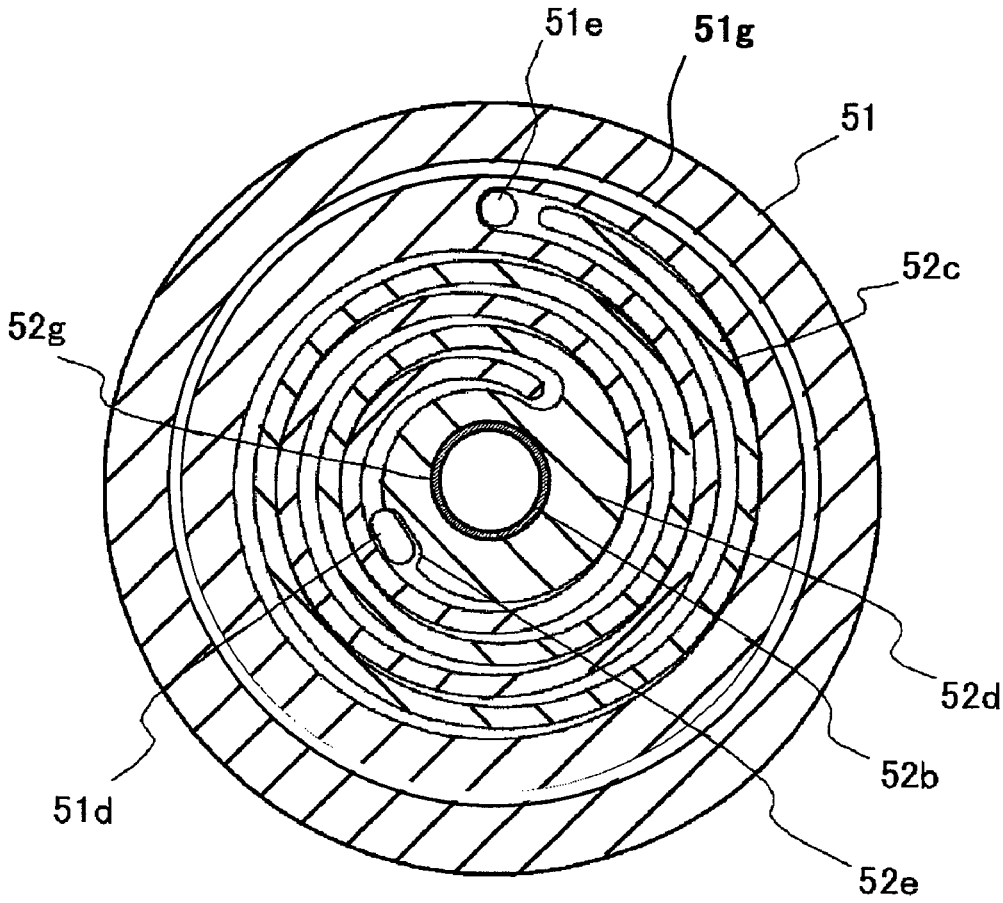
FIG. 10 is a cross sectional view of the expansion mechanism of the scroll-type expansion machine according to embodiment 2 of the present invention.
Figure 11A:
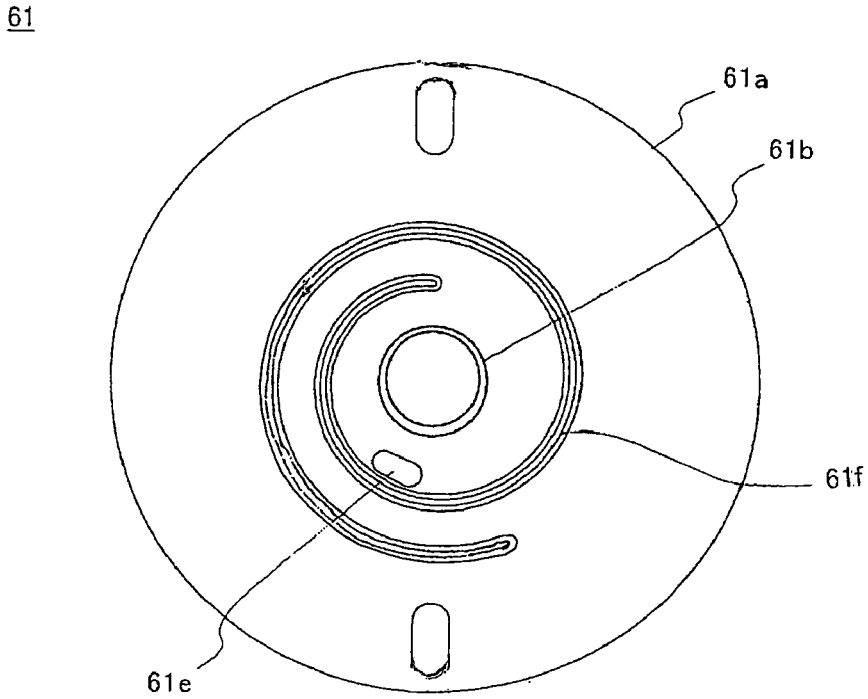
FIG. 11*a* is a plan view of the fixed scroll of the sub-compression mechanism of the scroll-type expansion machine according to embodiment 2 of the present invention.
Figure 11B:
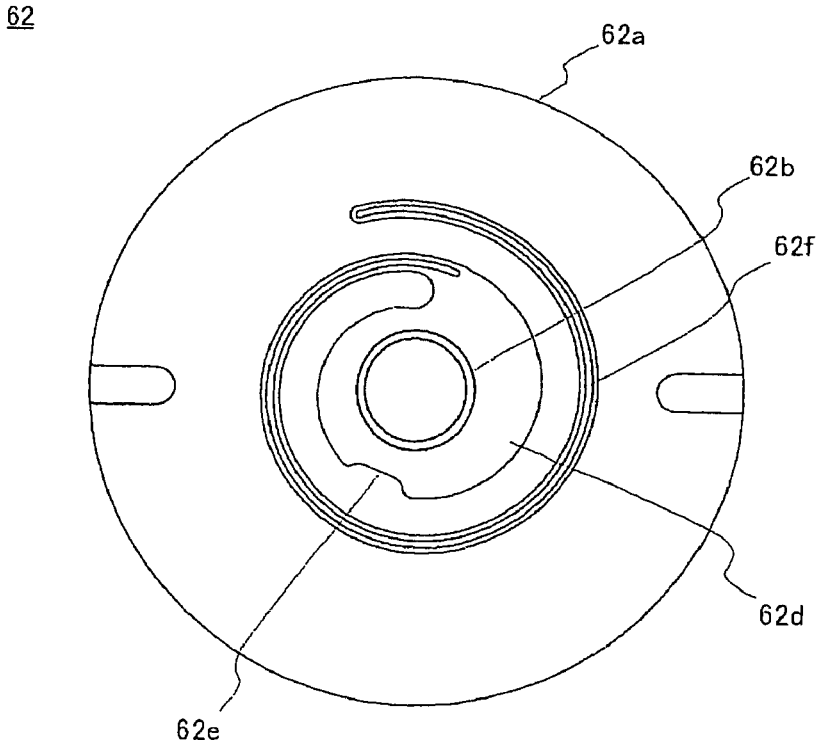
FIG. 11*b* is a plan view of the orbiting scroll of the sub-compression mechanism of the scroll-type expansion machine according to embodiment 2 of the present invention.

FIG. 9 is a longitudinal sectional view of the scroll-type expansion machine according to embodiment 2 of the present invention, FIG. 10 is a cross sectional view taken along line A-A of FIG. 9 showing the expansion mechanism of the scroll-type expansion machine according to embodiment 2 of the present invention, FIG. 11*a* is a plan view of the fixed scroll of the sub-compression mechanism of the scroll-type expansion machine according to embodiment 2 of the present invention, and FIG. 11*b* is a plan view of the orbiting scroll of the sub-compression mechanism of the scroll-type expansion machine according to embodiment 2 of the present invention.

In the scroll-type expansion machine 1 explained in embodiment 2, as shown in FIG. 9, the outer circumference seal 23*b* is disposed on the outside of the spiral teeth 51*c* on the base plate 51*a* of the fixed scroll 51 of the expansion mechanism 5, and no outer seal 23*a* is disposed on the base plate 61*a* of the fixed scroll 61 of the sub-compression mechanism 6. Also, in the fixed scroll 51 and the fixed scroll 61, an oil return bore 17*c* that does not pass through the orbiting scroll moving space 71 is provided, and a sub-compression suction pipe 12 for suctioning the refrigerant compressed in the main compressor 11 is opened in the orbiting scroll moving space 71 at a level lower than the Oldham ring 7 within the orbiting scroll moving space 71.

In other structure and function, the scroll-type expansion machine 1 of this embodiment 2 is similar to those of the scroll-type expansion machine 1.

In this scroll-type compression machine of this embodiment 2, similarly to embodiment 1, the expansion mechanism 5 carries out the expansion process of from the high pressure Ph to the low pressure Pl and the sub-compression mechanism 6 carries out the compression process from the intermediate pressure Pm to the high pressure Ph. Therefore, in the orbiting scrolls 52 and 62, the high pressure Ph acts at both of the central expansion chamber 5*a* and the central compression chamber 6*a*, the lower pressure Pl acts at the outer circumference expansion chamber 5*a*, and the intermediate pressure Pm acts at the outer circumference sub-compression chamber 6*a*. The refrigerant suctioned from the sub-compression suction pipe 12 disposed at the level lower than the Oldham ring 7 is suction from the outer circumference portion of the sub-compression mechanism 6 and compressed within the compression chamber 6*a*. The compressed refrigerant is discharged from the sub-compression discharge port 61*e* into the upper space 70 via the discharge valve 30 and thereafter discharged to the outside of the vessel. Then the lower space 72 becomes at the same compressed pressure as the upper spacer 70 through the oil return bore 71*c* which does not pass through the orbit scroll moving space 71. The orbiting scroll moving space 71 and the outer circumference portion of the expansion mechanism 5 which is at the low pressure Pl are sealed from each other by the outer circumference seal 23*b*, so that the orbiting scroll moving space 71 is at the intermediate pressure Pm.

Figure 12:
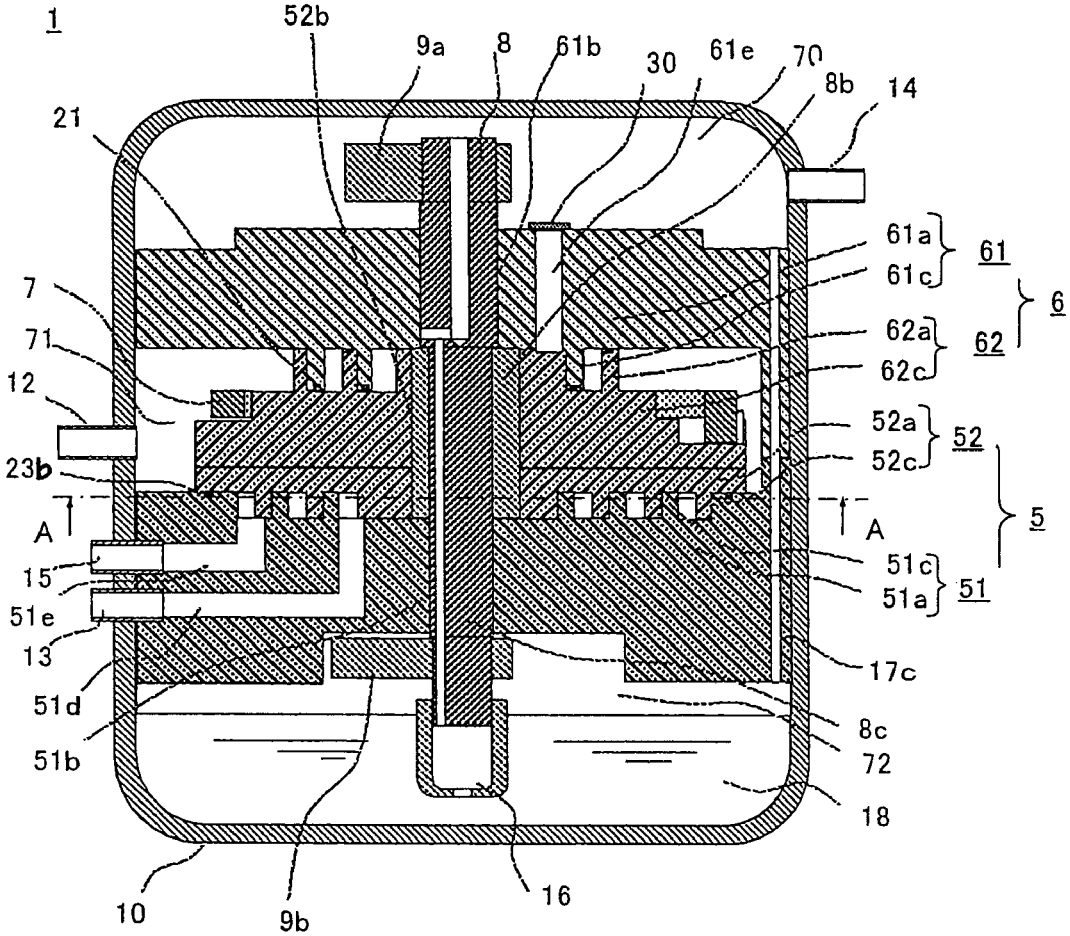
FIG. 12 is a schematic sectional view of the expansion mechanism and the sub-compression mechanism of the scroll-type expansion machine according to embodiment 2 of the present invention.
Figure 12:
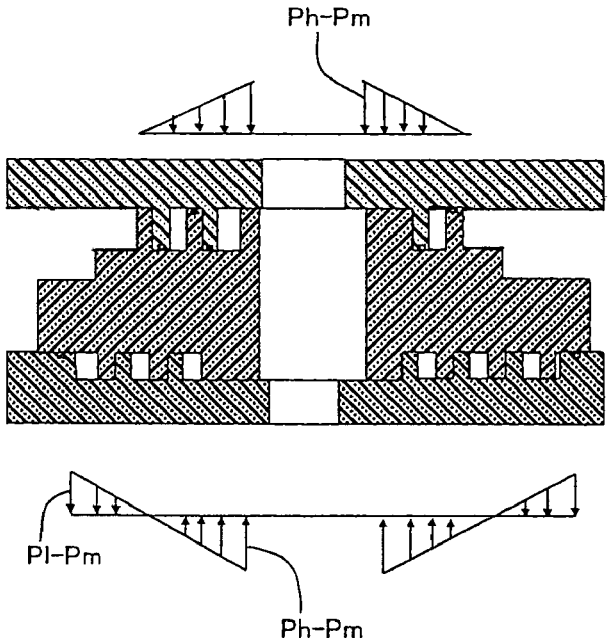

FIG. 12 is a schematic sectional view of the expansion mechanism and the sub-compression mechanism of the scroll-type expansion machine according to embodiment 2 of the present invention.

In FIG. 12, arrows represent the distribution of the pressure difference in the axial direction acting on the orbiting scrolls 52 and 62 with reference to the intermediate pressure Pm. The pressure differences at the central portion of the orbiting scrolls 52 and 62 on both of the side of the expansion mechanism 5 and the side of the sub-compression mechanism 6 are Ph-Pm and are equal to each other. However, the pressure difference at the outer circumference portion of the orbiting scrolls 52 and 62 is Pl-Pm on the side of the expansion mechanism 5 and is 0 on the side of the sub-compression mechanism 6. The orbiting scrolls 52 and 62 are subjected to a downward urging force F in the direction of the shaft 8 (the force from the side of the sub-compression mechanism 6 to the side of the expansion mechanism 5), the urging force F, which is an integrated pressure difference, being supported by the tip faces of the spiral teeth 51*c* and 52*c* of the expansion mechanism 5 and the base plate 51*a* and 52*a*.

The diameter of the outer circumference seal groove 51*g* in which the outer circumference seal 23*b* is mounted in the expansion mechanism 5 is selected so that the urging forces at the tip faces of the spiral teeth 51*c* and 52*c* of the expansion mechanism 5 as well as the base plates 51*a* and 52*a* does not become excessively large. That is, when the urging force is to be limited, the diameter of the outer circumference seal groove 51*g* is made small to decrease the area at which the expansion mechanism 5 receives the low pressure Pl.

Also, when the shaft 8 rotates due to the expansion power of the expansion mechanism 5, the oil supply pump 16 supplies the lubricating oil 18 to each of the bearing portions 61*b*, 62*b*, 52*b* and 51*b* via the oil supply port 8*c*. The amount of oil leaked from the bearing portions 61*b*, 62*b*, 52*b* and 51*b* into the upper space 70 is returned to the oil storage portion in the lower space 72 via the oil return bore 17*c*.

While the Oldham ring 7 is disposed within the orbiting scroll moving space 71 which is isolated from the oil-rich upper space 70 and the lower space 72, the arrangement is such that the refrigerant suctioned into the sub-compression mechanism 6 is suctioned from the underneath of the Oldham ring 7 within the orbiting scroll moving space 71, so that the sliding portion of the Oldham ring 7 can be lubricated by the oil entrained in the refrigerant circulating through the circuit.

Other operation of the scroll-type expansion machine 1 disclosed in embodiment 2 of this invention is similar to that of the scroll-type expansion machine 1 according to embodiment 1.

According to the above described construction, similarly to embodiment 1, one portion of the compression process of the refrigeration cycle is carried out by the sub-compression mechanism 6 of the scroll-type expansion machine 1, so that the decrease in the recovery effect due to the by-passing can be suppressed and the scroll-type expansion machine having a high efficiency over a wide range of operating condition can be obtained, and the structure of the discharge portion of the sub-compression mechanism 6 can be made simple and the oil amount circulating through the refrigerant cycle can be decreased, so that a high performance expansion machine at a low cost can be obtained.

Also, since the Oldham ring 7 is arranged to be lubricated by the oil circulating together with the suction gas of the sub-compression mechanism 6, an expansion machine of a high reliability can be obtained, and the outer circumference portions of the spiral teeth 61*c* and 62*c* at both sides of the sub-compression mechanism 6 is at the intermediate pressure Pm, so that the large diameter outer circumference seal 23*a* between the fixed scroll 61 and the orbiting scroll 62 are not necessary, enabling to decrease the manufacturing cost of the scroll-type expansion machine 1.

Embodiment 3

Figure 13:
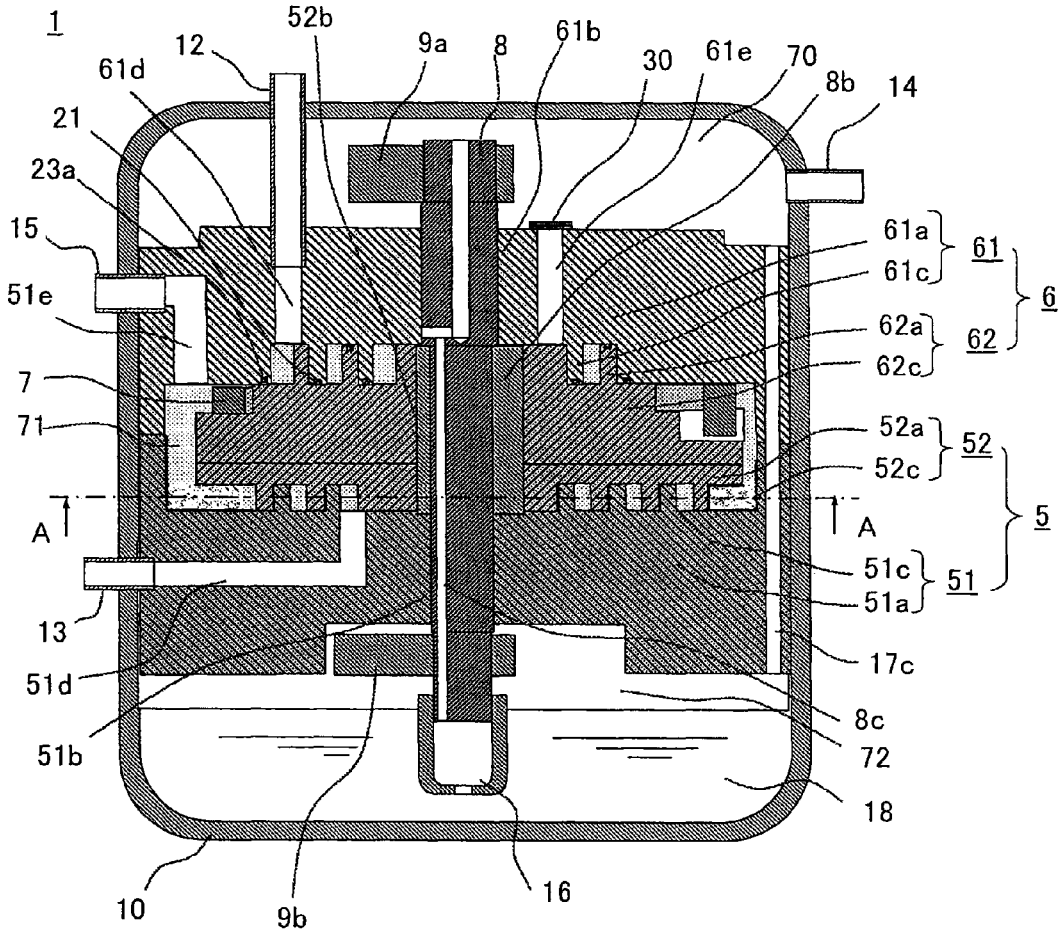
FIG. 13 is a longitudinal sectional view of the scroll-type expansion machine according to embodiment 3 of the present invention.
Figure 14:
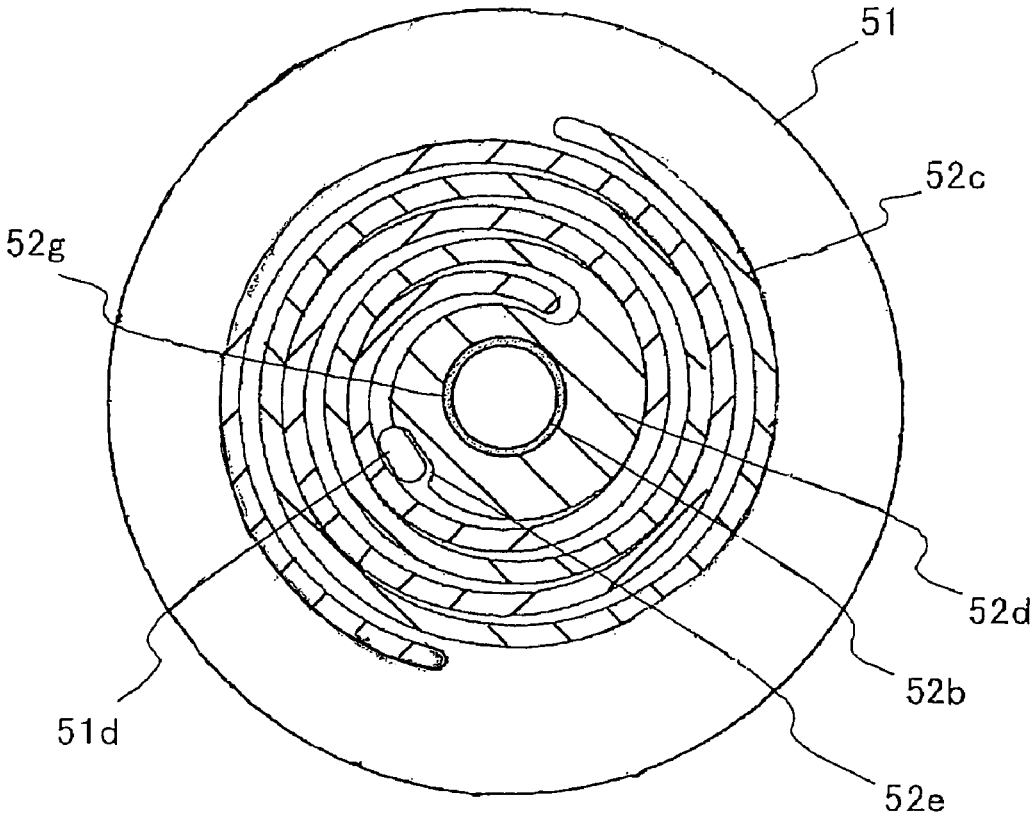
FIG. 14 is a cross sectional view of the expansion mechanism of the scroll-type expansion machine according to embodiment 3 of the present invention.
Figure 15A:
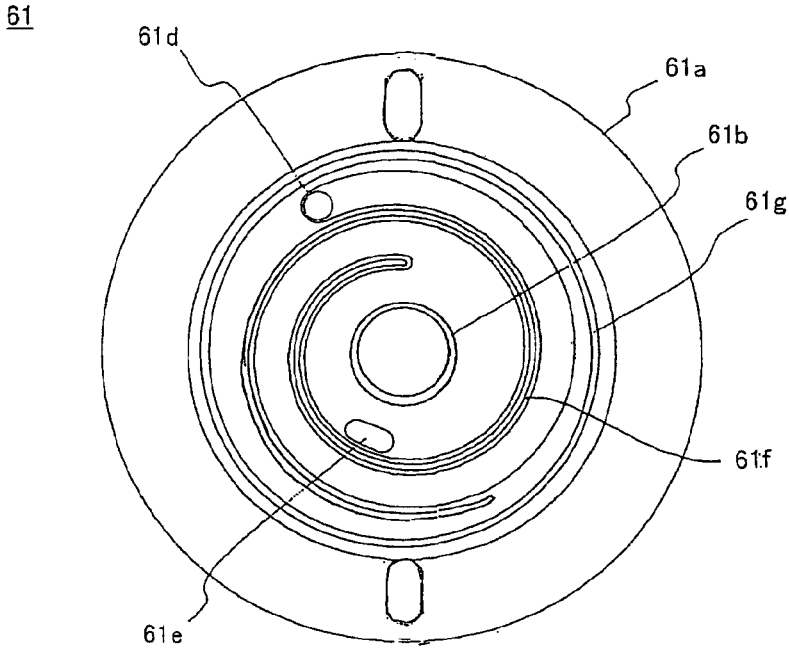
FIG. 15*a* is a plan view of the fixed scroll of the sub-compression mechanism of the scroll-type expansion machine according to embodiment 3 of the present invention.
Figure 15B:
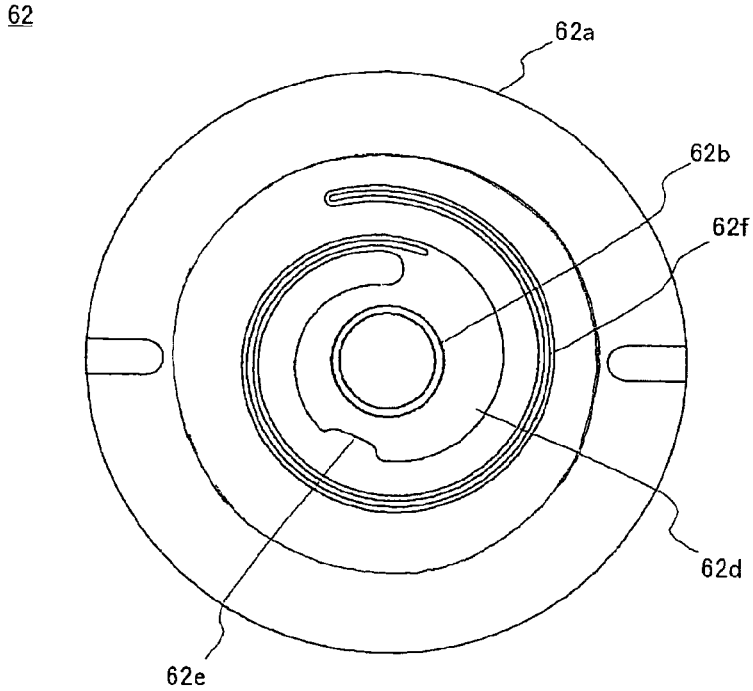
FIG. 15*b* is a plan view of the orbiting scroll of the sub-compression mechanism of the scroll-type expansion machine according to embodiment 3 of the present invention.

FIG. 13 is a longitudinal sectional view of the scroll-type expansion machine according to embodiment 3 of the present invention, FIG. 14 is a cross sectional view taken along line A-A of the expansion mechanism of the scroll-type expansion machine shown in FIG. 13 and according to embodiment 3 of the present invention, FIG. 15*a* is a plan view of the fixed scroll of the sub-compression mechanism of the scroll-type expansion machine according to embodiment 3 of the present invention, and FIG. 15*b* is a plan view of the orbiting scroll of the sub-compression mechanism.

In the scroll-type expansion machine 1 of embodiment 3 of this invention, as shown in FIG. 13, the outer circumference seal 23*a* is disposed at the outer circumference of the spiral teeth 61*c* on the base plate 61*a* of the fixed scroll 61 of the sub-compression mechanism 6, and the outer circumference seal 23*b* is not disposed on the base plate 51*a* of the fixed scroll 51 of the expansion machine 5. Also, the oil return bore 17*c* which does not pass through the orbiting scroll moving space 71 is disposed within the fixed scroll 51 and the fixed scroll 61, and the expansion discharge pipe 15 for discharging the expanded refrigerant is disposed above the Oldham ring 7 within the orbiting scroll moving space 71. Other structures and functions of the scroll-type expansion machine 1 according to embodiment 3 of the present invention are similar to those of the scroll-type expansion machine according to embodiment 1.

In this scroll-type compression machine of this embodiment 3, similarly to embodiment 1, the expansion mechanism 5 carries out the expansion process of from the high pressure Ph to the low pressure Pl and the sub-compression mechanism 6 carries out the compression process from the intermediate pressure Pm to the high pressure Ph. Therefore, in the orbiting scrolls 52 and 62, the high pressure Ph acts at both of the central expansion chamber 5*a* and the central compression chamber 6*a*, the lower pressure Pl acts at the outer circumference expansion chamber 5*a*, and the intermediate pressure Pm acts at the outer circumference sub-compression chamber 6*a*. The discharged gas compressed within the sub-compression mechanism 6 is discharged from the sub-compression discharge port 61*e* into the upper space 70 of the hermetic vessel 10 via the discharge valve 30 and thereafter discharged to the outside of the vessel. Then the lower space 72 becomes at the same compressed pressure as the upper spacer 70 through the oil return bore 71*c* which does not pass through the orbit scroll moving space 71. On the other hand, the refrigerant expanded within the expansion mechanism 5 is discharged from the expansion discharge pipe 15 to the outside of the vessel. The orbiting scroll moving space 71 and the outer circumference portion of the sub-compression mechanism 6 at the intermediate pressure Pm are sealed from each other by the outer circumference seal 23*a*, so that the orbiting scroll moving space 71 is at the expanded pressure.

Also, as shown in FIG. 15*a*, the center of the outer circumference seal groove 61*g* of the outer circumference seal 23*a* for isolating the orbiting scroll moving space 71 at the lower pressure Pl from the outer sub-compression chamber 6*a* at the intermediate pressure Pm is positioned closer to the center of the circumcircle from the center of the ordinates of the spiral teeth 61*c* of the fixed scroll 61. Therefore, the outer seal groove 61*g* has a smaller diameter, the area of the sub-compression mechanism 6 which receives the intermediate pressure Pm is limited, thereby preventing the urging forces at the tip ends of the spiral teeth 51*c* and 52*c* of the expansion mechanism 5 and the outer circumference portion of the base plate 51*a* and 52*a* becoming excessively large.

Figure 16:
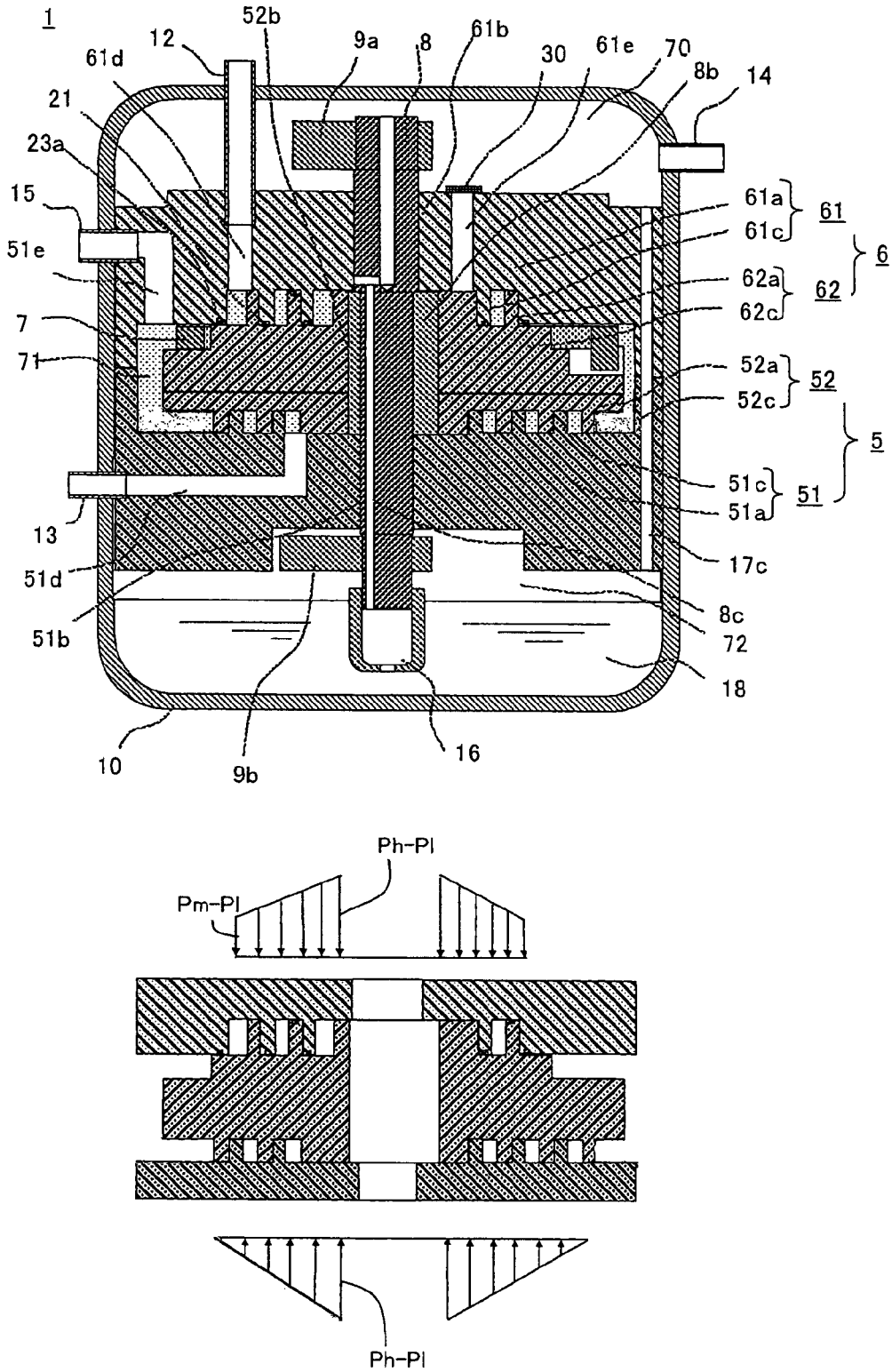
FIG. 16 is a schematic sectional view of the expansion mechanism and the sub-compression mechanism of the scroll-type expansion machine according to embodiment 3.

FIG. 16 is a schematic sectional view of the expansion mechanism and the sub-compression mechanism of the scroll-type expansion machine according to embodiment 3.

In FIG. 16, arrows represent the distribution of the pressure difference in the axial direction acting on the orbiting scrolls 52 and 62 with reference to the low pressure Pl. The pressure differences at the central portion of the orbiting scrolls 52 and 62 on both of the side of the expansion mechanism 5 and the side of the sub-compression mechanism 6 are Ph-Pl and are equal to each other. However, the pressure difference at the outer circumference portion of the orbiting scrolls 52 and 62 is zero on the side of the expansion mechanism 5 and is Pm-Pl on the side of the sub-compression mechanism 6. The orbiting scrolls 52 and 62 are subjected to a downward urging force F in the direction of the shaft 8 (the force from the side of the sub-compression mechanism 6 to the side of the expansion mechanism 5), the urging force F, which is an integrated pressure difference, being supported by the tip faces of the spiral teeth 51*c* and 52*c* of the expansion mechanism 5 and the base plate 51*a* and 52*a*.

When the shaft 8 rotates due to the expansion power of the expansion mechanism 5, the oil supply pump 16 supplies the lubricating oil 18 to each of the bearing portions 61*b*, 62*b*, 52*b* and 51*b* via the oil supply port 8*c*. The amount of oil leaked from the bearing portions 61*b*, 62*b*, 52*b* and 51*b* into the upper space 70 is returned to the oil storage portion in the lower space 72 via the oil return bore 17*c*.

While the Oldham ring 7 is disposed within the orbiting scroll moving space which is isolated from the oil-rich upper space 70 and the lower space 72, the arrangement is such that the expanded refrigerant is discharged from the upper portion of the Oldham ring 7 within the orbiting scroll moving space 71, so that the sliding portion can be lubricated and cooled by the oil entrained in the refrigerant circulating through the circuit and the expanded and cooled refrigerant.

Other operation of the scroll-type expansion machine 1 disclosed in embodiment 3 of this invention is similar to that of the scroll-type expansion machine 1 according to embodiment 1.

According to the above described construction, similarly to embodiment 1, one portion of the compression process of the refrigeration cycle is carried out by the sub-compression mechanism 6 of the scroll-type expansion machine 1, so that the decrease in the recovery effect due to the by-passing can be suppressed and the scroll-type expansion machine having a high efficiency over a wide range of operating condition can be obtained, and the structure of the discharge portion of the sub-compression mechanism 6 can be made simple and the oil amount circulating through the refrigerant cycle can be decreased, so that a high performance expansion machine at a low cost can be obtained.

Also, since the Oldham ring 7 is arranged to be lubricated and cooled by the discharged gas from the expansion mechanism 5 and the circulating oil, an expansion mechanism of a high reliability can be obtained, and the outer circumference portions of the spiral teeth 51*c* and 52*c* at both sides of the expansion mechanism 5 is at the low pressure Pl, so that the large diameter outer circumference seal 23*b* between the fixed scroll 51 and the orbiting scroll 52 are not necessary, enabling to decrease the manufacturing cost of the scroll-type expansion machine 1.

In this embodiment 3, a tension ring may be mounted inside of the outer circumference seal 23*a*, thereby further decreasing the leakage.

Embodiment 4

Figure 17A:
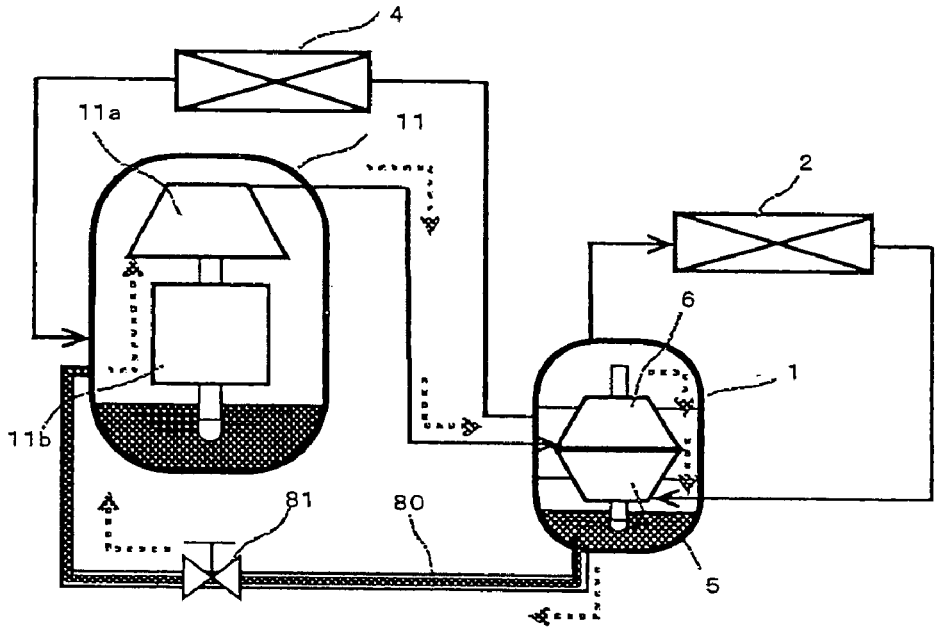
FIG. 17*a* is a circuit diagram showing the components of the oil supplying system the refrigeration cycle according to embodiment 4 of the present invention, in which the main compressor is at a suction pressure and the oil pipe is provided for connecting the suction space of the main compressor and the bottom surface of the expansion machine.
Figure 17B:
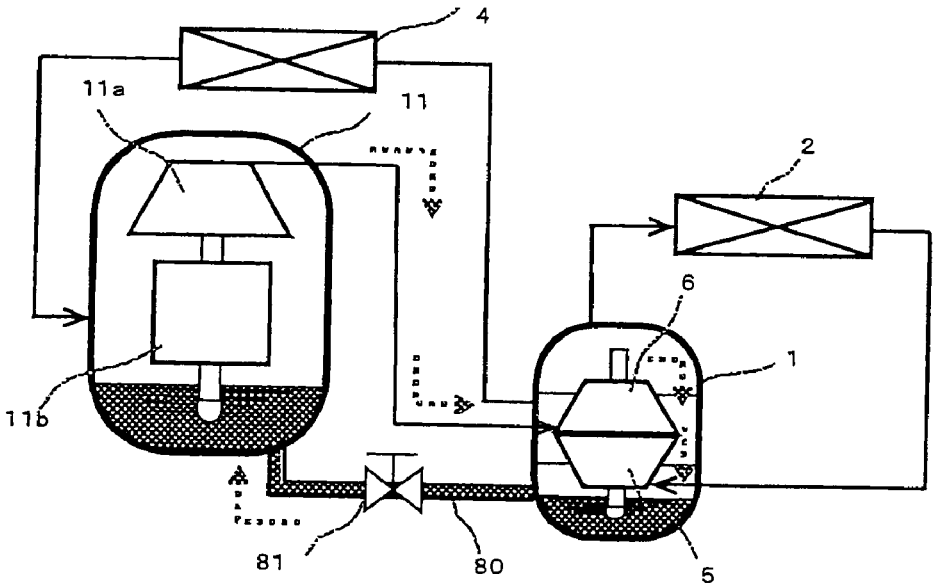
FIG. 17*b* is a circuit diagram showing the components of the oil supplying system the refrigeration cycle according to embodiment 4 of the present invention, in which the main compressor is at a suction pressure and the oil pipe is provided for connecting the oil reservoir of the main compressor and the expansion machine at a position higher than the proper oil level of the expansion machine.
Figure 17C:
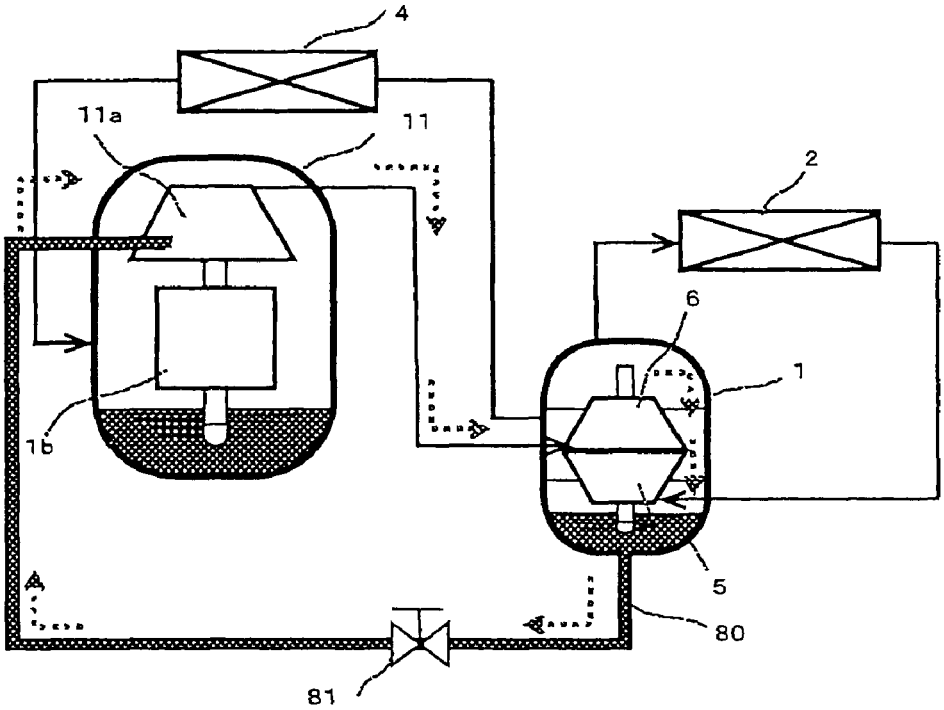
FIG. 17*c* is a circuit diagram showing the components of the oil supplying system the refrigeration cycle according to embodiment 4 of the present invention, in which the main compressor is at a suction pressure and the oil pipe is provided for connecting the compression chamber of the main compressor and the bottom surface of the expansion machine.
Figure 17D:
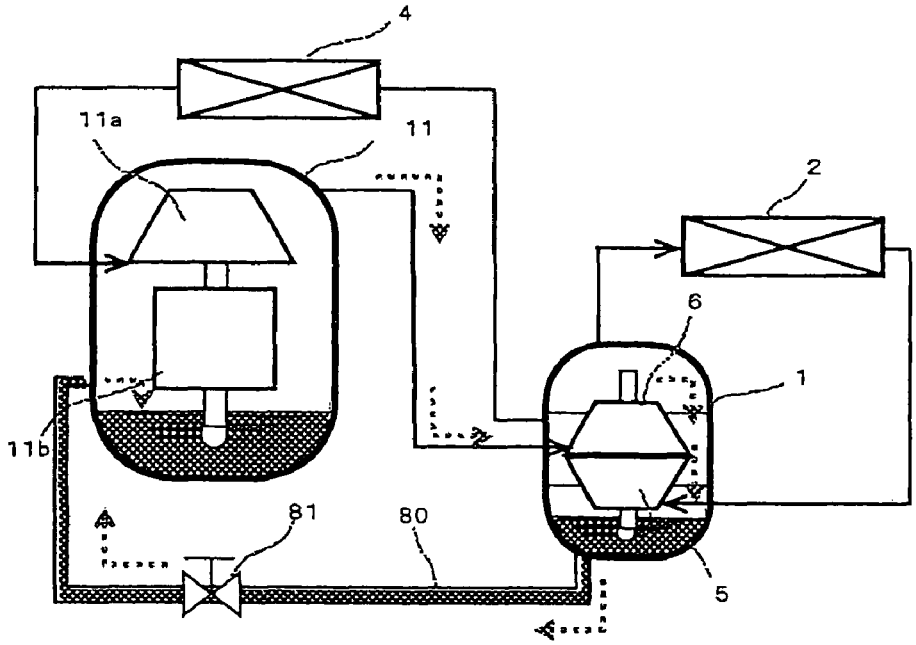
FIG. 17*d* is a circuit diagram showing the components of the oil supplying system the refrigeration cycle according to embodiment 4 of the present invention, in which the main compressor is at a discharge pressure and the oil pipe is provided for connecting the discharge space of the main compressor and the bottom surface of the expansion machine.
Figure 17E:
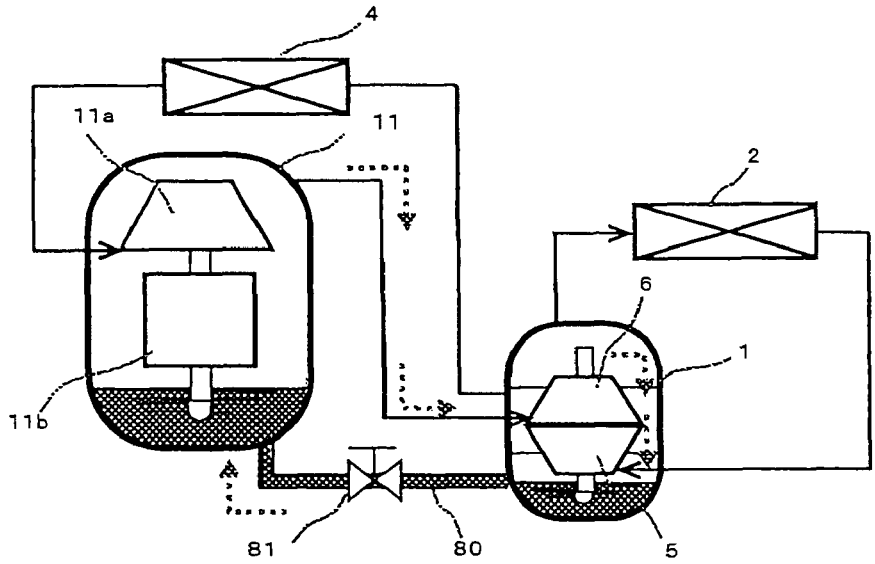
FIG. 17*e* is a circuit diagram showing the components of the oil supplying system the refrigeration cycle according to embodiment 4 of the present invention, in which the main compressor is at a discharge pressure and the oil pipe is provided for connecting the oil reservoir of the main compressor and the expansion machine at a position higher than the proper oil level of the expansion machine.
Figure 17F:
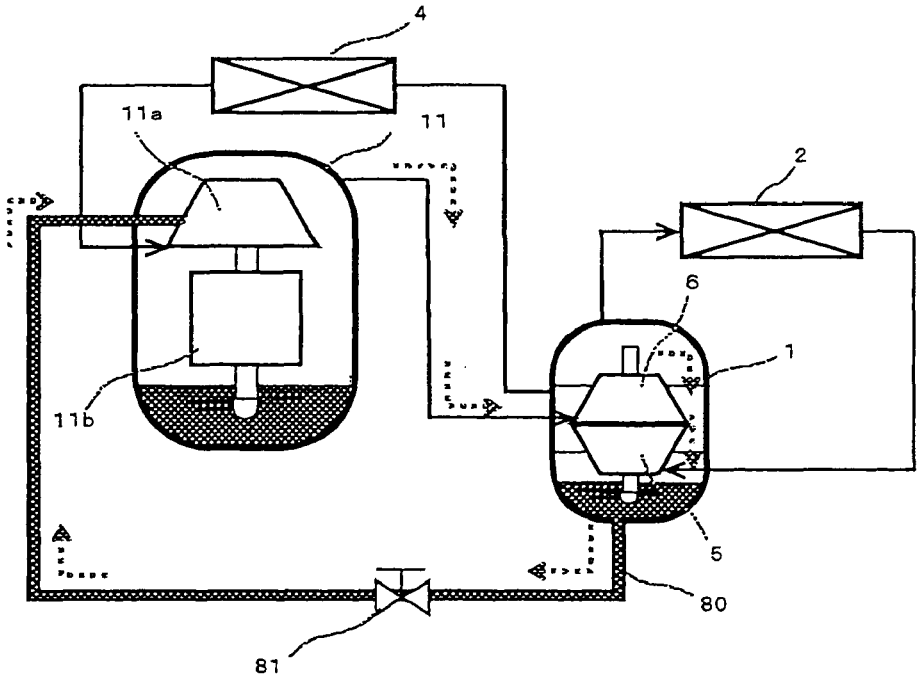
FIG. 17*f* is a circuit diagram showing the components of the oil supplying system the refrigeration cycle according to embodiment 4 of the present invention, in which the main compressor is at a discharge pressure and the oil pipe is provided for connecting the compression chamber of the main compressor and the bottom surface of the expansion machine.

FIGS. 17*a* to 17*f* are circuit diagrams of refrigeration cycles having a scroll-type expansion machine according to embodiment 4 together with an oil supplying system. FIG. 17*a* is a circuit diagram in which the main compressor is at a suction pressure (Pl) and an oil pipe 80 is provided for connecting the suction space of the main compressor 11 and the bottom surface of the expansion machine 1. FIG. 17*b* is a circuit diagram in which the main compressor 11 is at a suction pressure (Pl) and the oil pipe 80 is provided for connecting the oil reservoir of the main compressor 11 and the expansion machine 1 at a position higher than the proper oil level of the expansion machine 1. FIG. 17*c* is a circuit diagram in which the main compressor 11 is at a suction pressure (Pl) and the oil pipe 80 is provided for connecting the compression chamber of the main compressor 11 and the bottom surface of the expansion machine 1. FIG. 17*d* is a circuit diagram in which the main compressor is at a discharge pressure (Pm) and the oil pipe 80 is provided for connecting the discharge space of the main compressor 1 and the bottom surface of the expansion machine 1. FIG. 17*e* is a circuit diagram in which the main compressor 11 is at a discharge pressure (Pm) and the oil pipe 80 is provided for connecting the oil reservoir of the main compressor 11 and the expansion machine 1 at a position higher than the proper oil level of the expansion machine 1. FIG. 17*f* is a circuit diagram in which the main compressor 11 is at a discharge pressure (Pm) and the oil pipe 80 is provided for connecting the compression chamber of the main compressor 11 and the bottom surface of the expansion machine 1.

The oil supplying systems illustrated in FIGS. 17*a*, 17*b*, 17*d* and 17*e* have the oil pipes 80 for connecting the main compressor vessel 11 to the lower space 72 of the expansion machine 1 at a position above the proper oil level within the vessel or to the bottom of the vessel, so that the excess amount of oil of the expansion machine 1 may be returned into the main compressor 11, whereby the oil level within the expansion machine 1 can be maintained at a proper position.

This prevents the oil amount within the vessel 10 of the expansion machine 1 from being excessive and generating the agitation loss during normal operation.

Also, the oil 18 separated in the expansion machine 1 directly travels to the main compressor 11 without passing through the circuit between the main compressor 11 and the expansion machine 1, so that the expansion machine 1 functions as an oil separator for the main compressor 11, advantageously suppressing the degrading of the heat exchanger performance. That is, there is no need to provide an oil separation space within the oil separator or the main compressor vessel, providing a refrigerant system that is compact and efficient.

Also, as shown in FIGS. 17*c* and 17*f*, the oil pipe 80 may be employed as an oil injection pipe for supplying the lubricating oil 18 staying within the lower space 72 to the suction side or the compressor chamber of the main compressor 11, providing advantageous results that the compression chamber of the main compressor 11 becomes oil-rich and decreases the gap leakage and improve efficiency without degrading the heat exchanger performance.

That is, the amount of returned oil or the amount of oil supplied to the compression chamber of the main compressor 11 can be changed according to the position of connection of the oil pipe 80 at the side of the main compressor 11.

Figure 18:
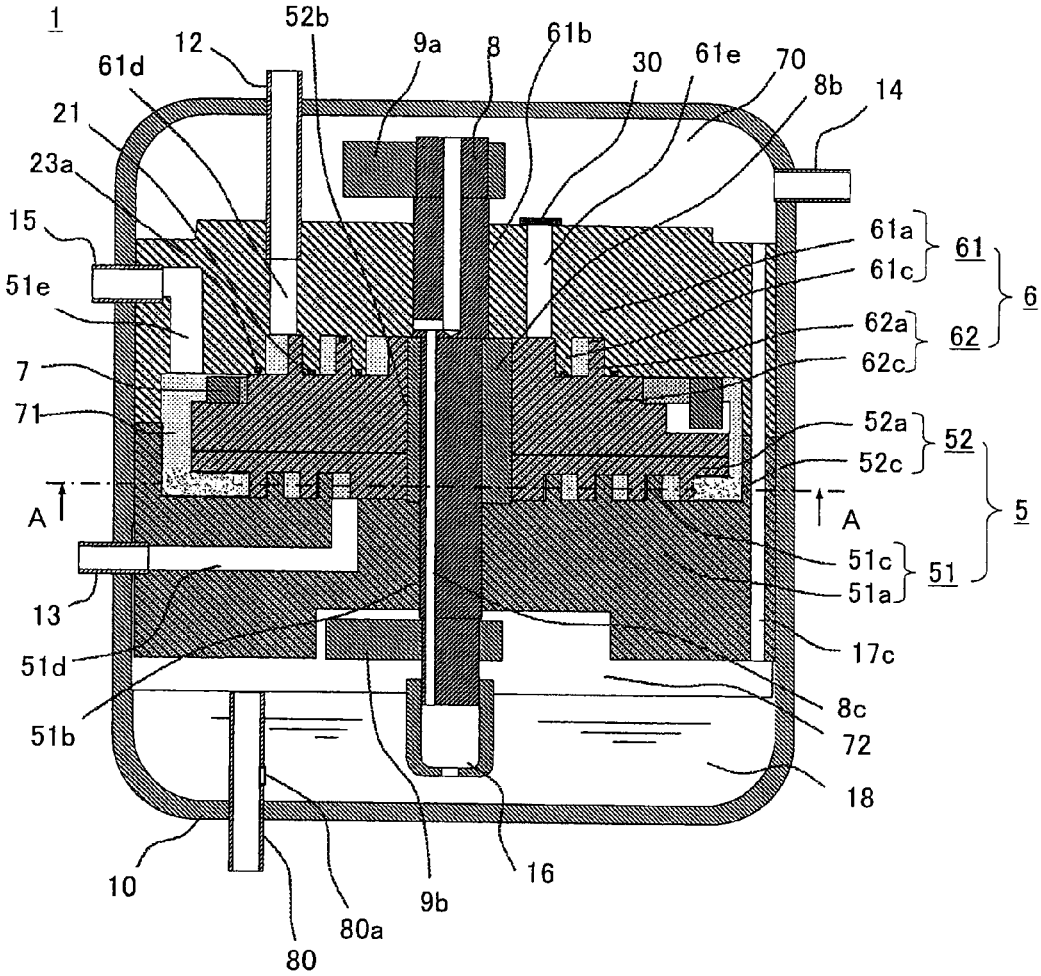
FIG. 18 is a schematic sectional view of the expansion mechanism and the sub-compression mechanism of the scroll-type expansion machine according to embodiment 4 of the present invention.

Also, as shown in FIG. 18, the oil pipe 80 may be projected from the bottom surface of the expansion machine 1 and provided with an oil port 80*a* at a side surface of the oil pipe 80, whereby the diameter of the oil port 80*a*, the height of the oil port 80*a* and the amount of projection of the oil pipe 80 may be suitably determined to design a suitable oil flow rate and an oil storing amount, thus improving the design efficiency.

In an oil supplying system for the refrigeration cycle provided with the scroll-type expansion machine according to embodiment 4 of the present invention, the oil pipe 80 may be provided with a shut-off valve 81 having an oil flow rate control function, providing an advantageous result that the oil level and the oil injection amount can be suitably adjusted.

Especially in the conventional refrigeration cycle in which the vessel of the main compressor 11 is at the discharge pressure atmosphere (Ph), there is no pressure difference between the oil separator and the main compressor 11, so that a head difference must be provided for the oil to be returned from the oil separator to the main compressor 11, thereby limiting the conditions of the installation. However, in the refrigeration cycle according to this embodiment, a pressure difference is generated between the expansion machine 1 and the main compressor 11 even when the vessel pressure of the main compressor 11 is at the discharge pressure atmosphere (Pm), posing no limitation on the installation conditions.

The invention claimed is:

1. A scroll-type expansion machine wherein a refrigeration cycle is constituted with a main compression mechanism for compressing a refrigerant, a gas cooler for cooling the refrigerant, and an evaporator for evaporating the refrigerant;

said scroll-type expansion machine comprising:

an expansion mechanism disposed within a hermetic vessel and including an orbiting scroll and a first fixed scroll for expanding a refrigerant from said gas cooler and recovering a power; and a scroll-type sub-compression mechanism disposed within said hermetic vessel and including an orbiting scroll including a base plate in common with the orbiting scroll of said expansion mechanism and coupled with a second fixed scroll for compressing the refrigerant compressed by said main compression mechanism by the power recovered by said expansion mechanism;

wherein said first fixed scroll and said second fixed scroll define within said hermetic vessel an upper space, an orbit scroll moving space, and a lower space;

said sub-compression mechanism includes a discharge port open within said upper space;

said upper space and said lower space are connected together by an oil flow path;

an outer circumference seal is disposed between said fixed scroll and said orbiting scroll of said sub-compression mechanism;

said oil flow path is an oil return bore communicating said upper space and said lower space together without passing through said orbiting scroll moving space; and wherein said orbiting scroll moving space is at an expanded pressure and said upper space and said lower space each is at a compressed pressure of said sub-compression mechanism.

2. A scroll-type expansion machine as claimed in claim 1, wherein said orbit scroll moving space includes an Oldham ring, and further comprising an expansion mechanism discharge pipe for discharging to the outside of an expansion machine vessel at a position higher than said Oldham ring.

3. A scroll-type expansion machine as claimed in claim 1, further comprising an oil pipe for connecting a main compressor vessel of said main compression mechanism or a compression chamber of said main compression mechanism to a bottom portion of said lower space of said hermetic vessel or a position higher than a proper oil level within said lower space.

4. A scroll-type expansion machine as claimed in claim 1, wherein said refrigerant is carbon dioxide.

5. A scroll-type expansion machine wherein a refrigeration cycle is constituted with a main compression mechanism for compressing a refrigerant, a gas cooler for cooling the refrigerant, and an evaporator for evaporating the refrigerant;

said scroll-type expansion machine comprising:

an expansion mechanism disposed within a hermetic vessel and including an orbiting scroll and a first fixed scroll for expanding a refrigerant from said gas cooler and recovering a power; and a scroll-type sub-compression mechanism disposed within said hermetic vessel and including an orbiting scroll including a base plate in common with the orbiting scroll of said expansion mechanism and coupled with a second fixed scroll for compressing the refrigerant compressed by said main compression mechanism by the power recovered by said expansion mechanism;

wherein said first fixed scroll and said second fixed scroll define within said hermetic vessel an upper space, an orbit scroll moving space, and a lower space;

said sub-compression mechanism includes a discharge port open within said upper space;

said upper space and said lower space are connected together by an oil flow path;

an outer circumference seal is disposed between said fixed scroll and said orbiting scroll of said expansion mechanism;

a sub-compressor suction pipe open within said orbiting scroll moving space is provided;

said oil flow path is an oil return bore communicating said upper space and said lower space together without passing through said orbiting scroll moving space; and wherein said orbiting scroll moving space is at a sub-compressor suction pressure and said upper space and said lower space are at a compressed pressure of said sub-compression mechanism.

6. A scroll-type expansion machine as claimed in claim 5, wherein said orbit scroll moving space includes an Oldham ring, and further comprising a sub-compressor suction pipe for suctioning into the sub-compression mechanism at a position lower than said Oldham ring.

7. A scroll-type expansion machine as claimed in claim 5, further comprising an oil pipe for connecting a main compressor vessel of said main compression mechanism or a compression chamber of said main compression mechanism to a bottom portion of said lower space of said hermetic vessel or a position higher than a proper oil level within said lower space.

8. A scroll-type expansion machine as claimed in claim 5, wherein said refrigerant is carbon dioxide.

9. A scroll-type expansion machine wherein a refrigeration cycle is constituted with a main compression mechanism for compressing a refrigerant, a gas cooler for cooling the refrigerant, and an evaporator for evaporating the refrigerant;

said scroll-type expansion machine comprising:

an expansion mechanism disposed within a hermetic vessel and including an orbiting scroll and a first fixed scroll for expanding a refrigerant from said gas cooler and recovering a power; and a scroll-type sub-compression mechanism disposed within said hermetic vessel and including an orbiting scroll including a base plate in common with the orbiting scroll of said expansion mechanism and coupled with a second fixed scroll for compressing the refrigerant compressed by said main compression mechanism by the power recovered by said expansion mechanism;

wherein said first fixed scroll and said second fixed scroll define within said hermetic vessel an upper space, an orbit scroll moving space, and a lower space;

said sub-compression mechanism includes a discharge port open within said upper space;

said upper space and said lower space are connected together by an oil flow path;

an outer circumference seal is disposed between said fixed scroll and said orbiting scroll of said expansion mechanism;

an outer circumference seal is disposed between said fixed scroll and said orbiting scroll of said sub-compression mechanism;

said oil flow path comprises a first oil return bore communicating said upper space and said orbiting scroll moving space and a second oil return bore communicating said orbiting scroll moving space said lower space; and wherein said orbiting scroll moving space, said upper space and said lower space are at a compressed pressure of said sub-compression mechanism.

10. A scroll-type expansion machine as claimed in claim 9, further comprising an oil pipe for connecting a main compressor vessel of said main compression mechanism or a compression chamber of said main compression mechanism to a bottom portion of said lower space of said hermetic vessel or a position higher than a proper oil level within said lower space.

11. A scroll-type expansion machine as claimed in claim 9, wherein said refrigerant is carbon dioxide.

12. A scroll-type expansion machine wherein a refrigeration cycle is constituted with a main compression mechanism for compressing a refrigerant, a gas cooler for cooling the refrigerant, and an evaporator for evaporating the refrigerant;

said scroll-type expansion machine comprising:

an expansion mechanism disposed within a hermetic vessel and including an orbiting scroll and a first fixed scroll for expanding a refrigerant from said gas cooler and recovering a power; and a scroll-type sub-compression mechanism disposed within said hermetic vessel and including an orbiting scroll including a base plate in common with the orbiting scroll of said expansion mechanism and coupled with a second fixed scroll for compressing the refrigerant compressed by said main compression mechanism by the power recovered by said expansion mechanism;

wherein said first fixed scroll and said second fixed scroll define within said hermetic vessel an upper space, an orbit scroll moving space, and a lower space;

said sub-compressor mechanism includes a discharge port open within said upper space;

said upper space and said lower space are connected together by an oil flow path; and wherein an oil pipe is provided for connecting a main compressor vessel of said main compression mechanism or a compression chamber of said main compression mechanism to a bottom portion of said lower space of said hermetic vessel or a position higher than a proper oil level within said lower space.

13. A scroll-type expansion machine as claimed in claim 12, wherein said refrigerant is carbon dioxide.

* * * * *